US006472117B2

(12) United States Patent
Kohyama et al.

(10) Patent No.: US 6,472,117 B2
(45) Date of Patent: Oct. 29, 2002

(54) TONER FOR DEVELOPING ELECTROSTATIC IMAGE AND IMAGE FORMING METHOD

(75) Inventors: Mikio Kohyama; Kenji Hayashi, both of Hino; Masafumi Uchida, Hachioji; Tsuyoshi Uchida, Hachioji; Hiroyuki Yamada, Hachioji, all of (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/909,351

(22) Filed: Jul. 19, 2001

(65) Prior Publication Data

US 2002/0037469 A1 Mar. 28, 2002

(30) Foreign Application Priority Data

Jul. 25, 2000 (JP) ..... 2000-223473

(51) Int. Cl.[7] ..... G03G 9/087

(52) U.S. Cl. ..... 430/110.3; 430/109.4; 430/111.4

(58) Field of Search ..... 430/110.3, 110.4, 430/109.4, 111.4

(56) References Cited

U.S. PATENT DOCUMENTS 6,096,468 A * 8/2000 Ohno et al. ..... 430/110
6,132,919 A * 10/2000 Ogawa et al. ..... 430/108.8
6,296,980 B1 * 10/2001 Oshiba et al. ..... 430/111

FOREIGN PATENT DOCUMENTS

JP 63027855 5/1988
JP 63027856 5/1988

OTHER PUBLICATIONS

*English Translation of Abstract only.

* cited by examiner

*Primary Examiner*—John Goodrow
(74) *Attorney, Agent, or Firm*—Bierman, Muserlian and Lucas

(57) ABSTRACT

A toner for developing an electrostatic image comprising a resin, a colorant and a releasing agent in which the toner particles are obtained by salting out/fusion-adhering a resin particle comprising a binding resin and a releasing agent together with a colorant particle is disclosed. The toner comprises the toner particles having a variation coefficient of not more than 16% and a number variation coefficient of the number particle size distribution of not more than 27%.

23 Claims, 2 Drawing Sheets

TONER HAVING NO CORNERS

TONER HAVING CORNERS

TONER HAVING CORNERS

TONER FOR DEVELOPING ELECTROSTATIC IMAGE AND IMAGE FORMING METHOD

FIELD OF THE INVENTION

This invention relates to a toner for developing an electrostatic image and an image forming method applicable in a copy machine or a printer.

BACKGROUND OF THE INVENTION

Currently, a technology for synthesizing a toner for developing an electrostatic image by a polymerization process has been known. However, the toner particle synthesized by a suspension polymerization method has a shortcoming that such the particle is inferior in the cleaning ability since it has a spherical shape.

Consequently, a method by which a resin particle prepared by a method such as a emulsifying polymerization method and a colorant particle are associated, by coagulation or fusion, is utilized for obtaining a toner particle having an irregular, non spherical, shape.

On the other hand, a heating roller fixing method by which an image forming support carrying thereon a toner image is passed between a heating roller and a pressure roller is utilized for fixing a toner image formed on the image forming support such as a paper sheet.

However, the heat roller fixing method has a shortcoming that a stain tends to be formed by an off-set phenomenon caused by adhesion of the fused toner onto the heating roller.

Then it has been known that silicone oil is coated on the surface of the heating roller of the fixing device for giving a toner releasing ability to the heating roller as a means for inhibiting the off-set phenomenon. Such the method is advantageous at a point that the kind of toner is not limited.

In such the method, however, the stain is become formed in the course of application for a long period since the silicone oil supplied for the long period on the surface of the heating roller is modified, gelled, and the releasing ability of the heating ability is reduced accompanied with the passing of the time. As a result, the life time of the fixing device is made shorter compared to the case in which no silicone oil is coated. Moreover, a volatile component contained in the silicone oil is volatilized by heat of the heating roller surface and adhered onto an optical system or an electrode of the apparatus, as a result of that a fault of the image is occurred.

From the viewpoint as above-mentioned, it is required to eliminate or extremely reduce the amount of the silicone oil to be supplied to the fixing device, heating roller.

Corresponding to such the requirement, it is widely applied to giving the releasing ability to the toner itself by addition of a releasing agent to the toner.

As the method for adding the releasing agent to the polymerized toner obtained by the polymerization method, a method by which the resin particle and a particle of the releasing agent is associated.

By such the method, however, the sufficient amount of the releasing agent cannot be introduced into the associated particle or colored particle. Furthermore, the contents of the releasing agent in the individual formed particles are different from each other. As a result, sufficient releasing property or anti-offset property of the whole toner cannot be realized.

Moreover, in the case of a developer comprising the associated particle composed of the resin particle and the releasing agent particle, the releasing agent is released from the associated particle and the released releasing agent causes degradation of the developer or gives a bad influence to the photoreceptor by adhering thereon.

As above-mentioned, any means to satisfy the anti-offset ability or releasing ability when no or extremely small amount of the releasing agent is supplied, has not be found yet.

On the other hand, it is necessary to raise the temperature and pressure of the fixing for increasing the fixing ability, or the adhesiveness of the toner to the image forming support. The offset tends to be occurred under both of such the conditions. Accordingly, many means for improving the anti-offset ability by selection of the resin from the viewpoint of the viscosity of the toner in the fused state have been proposed. It is extreme important problem in the fixing process that a fixable temperature range, or the range between the lowest fixing temperatures at which the fixing is can be carried out and the temperature at which the offset is occurred, can be made how wider. Such the problem is not sufficiently solved particularly when a small particle toner or a colored toner is used.

Moreover, there are a requirement to improve the initial image quality and problems such as the prevention of the degradation in the image quality and the fine line reproducibility accompanied with a repeating use of the toner. For example, it is necessary to solve the problems of lowering of the gradation and the fine line reproducibility, variation of the image density, unevenness of the density and fogging. Important causes of such the problems include difficulty and instability of the charging amount control of the toner. The controlling and stabilizing of the charging amount are considerably difficult since the triboelectricity is utilized for charging. Many means using a specific binder of toner, a charge controlling agent, an external additive or another additive have been proposed. However, a higher image quality and a higher durability of developer are further required accompanied with the raising in the performance and the reliability of each of the image forming processes.

Recently, the electrophotography is applied in various fields. For example, the electrophotography is used for not only a monochromatic copying machine but also for a printer to be used as an output terminal of computer, a color copying machine and a color printer. Accompanied with progress of such the applications, the requirement for the image quality is made higher. Particularly, in a multicolor image forming method in which a multicolor image is formed by plural toner images each composed of a color toner are piled up, a variation of the secondary color formed by the color pilling up is made larger by the small variation of the developing ability, or the amount of the toner, caused by a slight variation in the electro conductivity and a variation the transferring property of the halftone image. Consequently, the stabilization of the electro conductivity is strongly required. Moreover, the rising in the fine line reproducibility and the stability of the electro conductivity are also strongly required in an image formed by a digital exposure method.

It has been known as a technology to raise the fixing ability of a toner to make a micro domain by a crystalline substance such as crystalline polyester and an amorphous high molecular substance. Japanese Patent Publication Open to Public Inspection Nos. 63-27855 and 63-27856 each describes a toner containing a polymer prepared by chemically drafting or blocking amorphous vinyl polymer and crystalline polyester as a resin component. It is difficult, however, to lower the viscosity of the fused resin by the use of the crystalline polyester even when such the technology is applied, and there is a limitation on the raising of the fixing ability. For raising the fixing ability of the toner, the crystalline polyester must be existed uniformly in a certain ratio and maintaining some degree of the domain structure in the toner particle. However, any method to exist the crystalline polyester in such the status, the domain structure, is not known. Accordingly, the fixing ability can hardly be raised by introducing the crystalline polyester.

SUMMARY OF THE INVENTION

The first object of the invention is to provide a toner for developing an electrostatic image, which is excellent in the anti-offset ability and is able to give a high quality image without stain for a long period of time.

The second object of the invention is to provide a toner for developing an electrostatic image, which releases no substance to be adhered onto the photoreceptor.

The third object of the invention is to provide a toner for developing an electrostatic image, which is able to form an image without any stain and fault for a long period of time even when he toner is used in an image forming method including a process for forming a fixed image by a fixing device to which no or extreme small amount of silicone oil is supplied.

The fourth object of the invention is to provide a toner for developing an electrostatic image having a high fixing ability.

The fifth object of the invention is to provide a toner for developing an electrostatic image which is excellent in the developing ability and the fine line reproducibility and is able to form a high quality image for a long period of time.

The sixth object of the invention is to provide an image forming method using an excellent toner as above-mentioned.

The invention and its preferable embodiments are described.

1. A toner for developing an electrostatic image comprising a resin, a colorant and a releasing agent, wherein the toner particles are obtained by salting out/fusion-adhering a resin particle comprising a binding resin and a releasing agent together with a colorant particle, and the toner comprises the toner particles having a variation coefficient of not more than 16% and a number variation coefficient of the number particle size distribution of not more than 27%.
2. The toner of item 1 wherein the toner particles not less than 65% in number has a shape coefficient of from 1.0 to 1.6.
3. The toner of item 1 wherein the toner particles not less than 65% in number has a shape coefficient of from 1.2 to 1.6.
4. The toner of item 1 wherein the toner particles not less than 50% in number are particles having no corner.
5. The toner of item 1 wherein a number average particle size of the toner particles is from 3 to 8 $\mu$m.
6. The toner of item 1 wherein a sum M of at least 70 percent, sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in $\mu$m) represents the particle size of a toner particle, while being divided into a plurality of classes at intervals of 0.23, and the number of particles is used as an ordinate.
7. The toner of item 2 wherein the toner particles not less than 50% in number are particles having no corner and a number average particle size of the toner particles is from 3 to 8 $\mu$m.
8. The toner of item 1 wherein the releasing agent is represented by the Formula (1), $$R^1\text{—}(OCO\text{—}R^2)_n \quad (1):$$

wherein $R^1$ and $R^2$ each represent a hydrocarbon group having from 1 to 40 carbon atoms, which may have a substituent, and n is an integer of 1 to 4.

9. The toner of item 8 wherein $R^1$ represent a hydrocarbon group having from 1 to 20 carbon atoms, and $R^2$ represent a hydrocarbon group having from 16 to 30 carbon atoms and n is an integer of from 2 to 4.
10. The toner of item 1 wherein content ratio of the releasing agents in the toner is from 1 to 30 percent by weight.
11. The toner of item 1 wherein melting point of the crystalline polyester is from 50 to 130° C.
12. The toner of item 1 wherein number average molecular weight of crystalline polyester is from 1,500 to 15,000, and melt viscosity of a crystalline polyester (viscosity at melting point plus 20 degrees) is not more than 100 dPa·s.
13. The toner of item 1 wherein a containing ratio of crystalline polyester in the toner is 1–50 weight parts.
14. The toner of item 7 wherein the releasing agent is represented by the Formula (1), $$R^1\text{—}(OCO\text{—}R^2)_n \quad (1):$$

wherein $R^1$ and $R^2$ each represent a hydrocarbon group having from 1 to 40 carbon atoms, which may have a substituent, and n is an integer of 1 to 4, melting point of the crystalline polyester is from 50 to 130° C., and number average molecular weight of crystalline polyester is from 1,500 to 15,000, and melt viscosity of a crystalline polyester (viscosity at melting point plus 20 degrees) is not more than 100 dPa·s.

15. A toner for developing an electrostatic image comprising a resin, a colorant and a releasing agent, wherein the toner particles are obtained by salting out/fusion-adhering a resin particle comprising a binding resin and a releasing agent together with a colorant particle, and the toner comprises the toner particles having no corner of not less than 50% in number, and a number variation coefficient of the number particle size distribution of not more than 27%.
16. The toner of item 7 wherein the toner particles not less than 65% in number has a shape coefficient of from 1.0 to 1.6.
17. The toner of item 8 wherein the toner particles not less than 65% in number has a shape coefficient of from 1.2 to 1.6.
18. The toner of item 10 wherein the toner particles not less than 50% in number are particles having no corner and a number average particle size of the toner particles is from 3 to 8 $\mu$m.
19. The toner of item 8 wherein a sum M of at least 70 percent, sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in $\mu$m) represents the particle size of a toner particle, while being divided into a plurality of classes at intervals of 0.23, and the number of particles is used as an ordinate.

20. The toner of item 15 wherein the releasing agent is represented by the Formula (1), $$R^1—(OCO—R^2)_n \quad (1):$$

wherein $R^1$ and $R^2$ each represent a hydrocarbon group having from 1 to 40 carbon atoms, which may have a substituent, and n is an integer of 1 to 4, melting point of the crystalline polyester is from 50 to 130° C., and number average molecular weight of crystalline polyester is from 1,500 to 15,000, and melt viscosity of a crystalline polyester (viscosity at melting point plus 20 degrees) is not more than 100 dPa·s.

21. A toner for developing an electrostatic image comprising a resin, a colorant and a releasing agent, wherein the toner particles are obtained by salting out/fusion-adhering a resin particle comprising a binding resin and a releasing agent together with a colorant particle, and the toner particles not less than 65% in number has a shape coefficient of from 1.2 to 1.6, and a variation coefficient of the toner particles is not more than 16%.

22. The toner of item 21 wherein the toner particles not less than 50% in number are particles having no corner.

23. The toner of item 21 wherein a sum M of at least 70 percent, sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in ρm) represents the particle size of a toner particle, while being divided into a plurality of classes at intervals of 0.23, and the number of particles is used as an ordinate.

24. The toner of item 21 wherein the releasing agent is represented by the Formula (1), $$R^1—(OCO—R^2)_n \quad (1):$$

wherein $R^1$ and $R^2$ each represent a hydrocarbon group having from 1 to 40 carbon atoms, which may have a substituent, and n is an integer of 1 to 4, melting point of the crystalline polyester is from 50 to 130° C., and number average molecular weight of crystalline polyester is from 1,500 to 15,000, and melt viscosity of a crystalline polyester (viscosity at melting point plus 20 degrees) is not more than 100 dPa·s.

BRIEF DESCRIPTION THE DRAWING

DETAILED DESCRIPTION OF THE INVENTION

Figure 1:
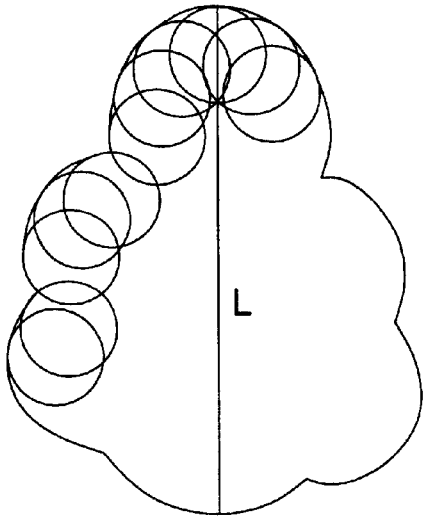
FIG. 1(*a*) is a schematic view of the projected toner particle having no corner, and FIG. 1(*b*) and FIG. 1(*c*) are each a schematic view of the projected toner particle having a corner.
Figure 1:
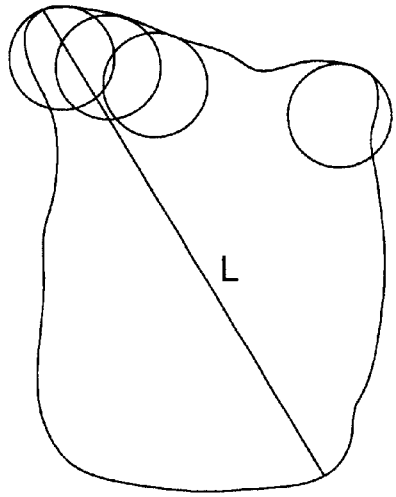
Figure 1:
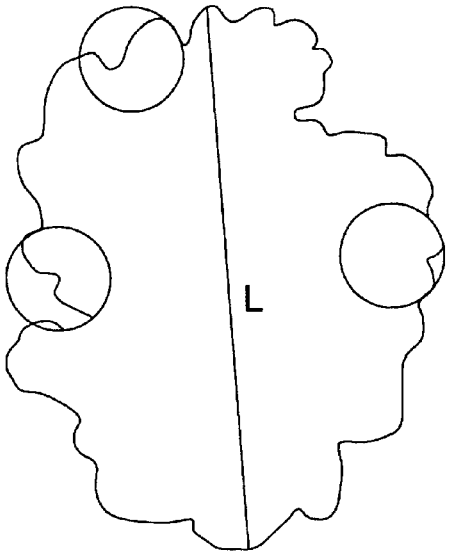

Other embodiments of the invention are described.

The toner for developing an electrostatic image according to the invention is a toner for developing an electrostatic image at least contains a resin, a colorant and a releasing agent wherein the toner particles are obtained by salting out/fusion-adhering a resin particle comprising a binding resin and a releasing agent together with a colorant particle, and the toner comprises the toner particles having a variation coefficient of not more than 16% and a number variation coefficient of the number particle size distribution of not more than 27%.

The toner for developing an electrostatic image according to the invention is a toner for developing an electrostatic image at least contains a resin, a colorant and a releasing agent wherein the toner particles are obtained by salting out/fusion-adhering a resin particle comprising a binding resin and a releasing agent together with a colorant particle, and the toner comprises toner particles having a ratio of the particles having no corners is not less than 50% and a number variation coefficient of the number particle size distribution of not more than 27%.

The toner for developing an electrostatic image according to the invention is a toner for developing an electrostatic image at least contains a resin, a colorant and a releasing agent wherein the toner particles are obtained by salting out/fusion-adhering a resin particle comprising a binding resin and a releasing agent together with a colorant particle, and the toner comprises toner particles having a ratio of the toner particles having a shape coefficient within the range of from 1.2 to 1.6 of not less than 65% in number and a variation coefficient of the shape variation of not more than 16%.

The image forming method according to the invention is a method including a fixing process by passing an image forming support on which a toner image is formed by a toner at least comprising a resin, a releasing agent and a colorant between a heating roller and a pressure roller, wherein the toner particles are obtained by salting out/fusion-adhering a resin particle comprising a binding resin and a releasing agent together with a colorant particle, and the toner comprises the toner particles having a variation coefficient of not more than 16% and a number variation coefficient of the number particle size distribution of not more than 27%.

The image forming method according to the invention is a method including a fixing process by passing an image forming support on which a toner image is formed by a toner at least comprising a resin, a releasing agent and a colorant between a heating roller and a pressure roller, wherein the toner particles are obtained by salting out/fusion-adhering a resin particle comprising a binding resin and a releasing agent together with a colorant particle, and the toner comprises the toner particles having a ratio of the particles having no corners is not less than 50% and a number variation coefficient of the number particle size distribution of not more than 27%.

The image forming method according to the invention is a method including a fixing process by passing an image forming support on which a toner image is formed by a toner at least comprising a resin, a releasing agent and a colorant between a heating roller and a pressure roller, wherein the toner particles are obtained by salting out/fusion-adhering a resin particle comprising a binding resin and a releasing agent together with a colorant particle, and the toner comprises the toner particles having a ratio of the toner particles having a ratio of toner particle having a shape coefficient within the range of from 1.2 to 1.6 of not less than 65% in number and a variation coefficient of the shape variation of not more than 16%.

The toner for developing an electrostatic image according to the invention is a toner for developing an electrostatic image at least contains a resin, a colorant and crystalline polyester wherein the toner particles are obtained by salting out/fusion-adhering a resin particle comprising a binding resin and crystalline polyester, and the toner comprises the toner particles having a variation coefficient of not more than 16% and a number variation coefficient of the number particle size distribution of not more than 27%.

The toner for developing an electrostatic image according to the invention is a toner for developing an electrostatic image at least contains a resin, a colorant and crystalline polyester wherein the toner particles are obtained by salting out/fusion-adhering a resin particle comprising a binding resin and crystalline polyester, and the toner comprises the toner particles having a ratio of the particles having no corners is not less than 50% and a number variation coefficient of the number particle size distribution of not more than 27%.

The toner for developing an electrostatic image according to the invention is a toner for developing an electrostatic image at least contains a resin, a colorant and crystalline polyester wherein the toner particles are obtained by salting out/fusion-adhering a resin particle comprising a binding resin and crystalline polyester, and the toner comprises the toner particles having a ratio of the toner particles having a ratio of toner particle having a shape coefficient within the range of from 1.2 to 1.6 of not less than 65% in number and a variation coefficient of the shape variation of not more than 16%.

The image forming method according to the invention is a method including a fixing process by passing an image forming support on which a toner image is formed by a toner at least comprising a resin, crystalline polyester and a colorant between a heating roller and a pressure roller, wherein the toner particles are obtained by salting out/fusion-adhering a resin particle comprising a binding resin and crystalline polyester together with a colorant particle, and the toner comprises the toner particles having a variation coefficient of not more than 16% and a number variation coefficient of the number particle size distribution of not more than 27%.

The image forming method according to the invention is a method including a fixing process by passing an image forming support on which a toner image is formed by a toner at least comprising a resin, crystalline polyester and a colorant between a heating roller and a pressure roller, wherein the toner particles are obtained by salting out/fusion-adhering a resin particle comprising a binding resin and crystalline polyester together with a colorant particle, and the toner comprises the toner particles having a ratio of the particles having no corners is not less than 50% and a number variation coefficient of the number particle size distribution of not more than 27%.

The toner for developing an electrostatic image according to the invention is a toner for developing an electrostatic image at least contains a resin, a colorant and crystalline polyester wherein the toner particles are obtained by salting out/fusion-adhering a resin particle comprising a binding resin and crystalline polyester, and the toner comprises the toner particles having a ratio of the toner particles having a ratio of toner particle having a shape coefficient within the range of from 1.2 to 1.6 of not less than 65% in number and a variation coefficient of the shape variation of not more than 16%.

Improvement in the Anti-offset Property and the Fixing Ability (1) In the toner for developing an electro static image, the releasing agent is uniformly distributed in individual particle even though the toner contains a releasing agent immiscible with the binding resin. Accordingly, the difference of the anti-offset property and the fixing ability between each of the individual particles is made small. Consequently, the difference of the releasing ability and that of the fixing ability between the individual particles can be reduced, the occurrence of fine offset can be inhibited even when the toner is used to image formation for a long period of time, and the contamination of the surface of heating roller and pressure roller and that of the image can also be inhibited.

(2) In the toner for electrostatic image developer, the crystalline polyester is uniformly distributed regarding the individual particles even though the crystalline polyester immiscible with the binding resin is contained. Accordingly, the particles are similar in the fixing ability and the anti-offset ability.

Namely, the crystalline polyester can be existed in the toner particle, associated particle, in the state of the fine domain structure, and the difference of the dispersion status (dispersed region, dispersed amount) and the surface condition between each of the individual particles can be reduced by salting out/fusion-adhering the resin particles containing the crystalline polyester and the colorant particles.

(3) The invention is based on the finding that the anti-offset ability and the fixing ability can be raised by using the toner, hereinafter referred to Toner A, comprising the toner particles having a variation coefficient of the shape coefficient of not more than 16% and a number variation coefficient of the number particle size distribution of not more than 27%.

(4) It is found that the similar effects can be obtained when the toner particles each has no corner since the shape of each of the particle is rounded and smooth so that the fusion adhesion between the particles is accelerate. The invention is based on the finding that the anti-offset ability and the fixing ability can be raised by using the toner, hereinafter referred to Toner B, comprising the toner particles having a ratio of the particles having no corner of not less than 50% and a number variation coefficient of the number particle size distribution of not more than 27%.

(5) It is found that he similar effects can be obtained when the shapes of the toner particles are specified and uniformed since the packing density of the toner particles in a toner layer is raised and the spaces between the toner particles are reduced. The invention is based on the finding that the anti-offset ability and the fixing ability can be raised by using the toner, hereinafter referred to Toner C, comprising the toner particles having a ratio of the toner particles having a shape coefficient within the range of from 1.2 to 1.6 is not less than 65% in number and a variation coefficient of the shape coefficient of not more than 16%.

Improvement of the Developing Ability and the Fine Line Reproducibility

The toner according to the invention is excellent in the developing ability and the fine line reproducibility, and a high quality image can be formed by the toner for a long period of time. It is found by the inventors that the use of the toner composed of particles having not uniform shape or particles each having a corner tend to cause the contamination of the carrier, the developing sleeve and the charging member. It is supposed that the particles are easily received mechanical stress caused by stirring in the developing apparatus and the part to which the stress is excessively applied is formed when there shapes are not uniform and the compositions of the toner are transferred and adhered to the contamination receiving material so as to vary the charging property of the toner even though the reason of such the phenomena is not made clear yet.

Such the stress applying condition is different depending on the diameter of the toner particle. The particle having a small diameter easily causes the contamination when such particle receives the stress since the smaller particle has a higher adhesive force. In the case of the large toner particle, such the contamination is reduced but the problem of degradation of the image quality such as resolving power is occurred.

The initial charged amount distribution of the toner particles is also important regarding such the contamination. When the charged amount distribution is too broad, so-called selective development is occurred in the image forming process, and problems such as the degradation of the developing ability caused by accumulation of toner particles not effective for development, the formation of contamination caused by the stress applied for a long period of time to the accumulated toner particles and the degradation of image quality caused by the formation of low charged or reverse polarity charged particles which are formed by change of the charging property caused by changing the surface property of the toner particle by the stress.

It is found that the diameter and the shape of the toner particles have to be controlled to be narrow for making the charge amount distribution of the toner to extremely sharp. Stable charging properties can be obtained for a long period of time by making extreme sharp the charging amount distribution.

The invention is based on the finding from the above-viewpoint that a high quality image excellent in the developing ability and the fine line reproducibility by the use of Toner A comprising the toner particles having a variation coefficient of the shape coefficient of not more than 16% and a number variation coefficient of the number particle size distribution of not more than 27%.

As a result of the study by the inventors on the detail of the shape of the toner particle, it is found that the corner portion of the toner particle is rounded in the developing apparatus and the crushed portion of the particle causes the occurrence of the stain. It is supposed that the corner portion tends to receive the stress and such the portion is easily worn or crushed. Thus compositions of the toner are transferred to the contamination receiving material and vary the charging property of the toner, even though the reason of such the phenomenon is not cleared yet.

Moreover, it is supposed that the charge on the toner particle tends to be not uniform since the charge is easily concentrated to the corner portion of the toner particle when the charge is given by triboelectrification.

The invention is based on the finding from the above-viewpoint that a high quality image excellent in the developing ability and the fine line reproducibility by the use of Toner B comprising toner particles having a ration of the particle having no corner of not less than 50% in number and a number variation coefficient of the number particle size distribution of not more than 27%.

Moreover, it is found that the stain caused by the compositions of the toner is reduced and the distribution of the charging amount is made narrow when the shape of the toner particle is made to a specific shape and the shape is made uniform regarding the toner particles.

The invention is based on the finding from the above-viewpoint that a high quality image excellent in the developing ability and the fine line reproducibility by the use of Toner C having a ratio of the particles having a shape coefficient within the range of from 1.2 to 1.6 is not less than 65% in number and a variation coefficient of the shape coefficient of not more than 16%.

Toner A according to the invention comprises toner particles having a variation coefficient of the shape coefficient of not more than 16% and a number variation coefficient of the number particle size distribution of not more than 27%.

Toner B according to the invention comprises toner particles having a ration of the particle having no corner of not less than 50% in number and a number variation coefficient of the number particle size distribution of not more than 27%.

Toner C according to the invention comprises toner particles having a ratio of the particles having a shape coefficient within the range of from 1.2 to 1.6 is not less than 65% in number and a variation coefficient of the shape coefficient of not more than 16%.

The shape coefficient of the toner of the present invention is represented by the formula described below and shows the degree of roundness of toner particles.

$$\text{Shape coefficient}=[(\text{Maximum diameter}/2)^2\times\pi]/\text{Projection area}$$

Wherein the maximum diameter denotes the width of a particle, which is the distance between parallel lines when a projected image of a toner particle on a screen is placed between said parallel lines and the distance between said parallel lines becomes maximum. Further, the projection area denotes the area of the projected image of a toner particle on a screen.

In the present invention, said shape coefficient was measured as follows. Toner particles were magnified to a factor of 2000 employing a scanning electron microscope and a photograph of said magnified toner particles was taken. The resulting photographic images were analyzed employing a Scanning Image Analyzer (manufactured by Nippon Denshi Co.). One hundred toner particles were measured and the shape coefficient of the present invention was calculated according to the above-mentioned formula.

In toner (A) and toner (B), the ratio of toner particles which have said shape coefficient in the range of 1.0 to 1.6 is preferably at least 65 percent by number, and is more preferably at least 70 percent by number. Still more preferably, the ratio of toner particles which have said shape coefficient in the range of 1.2 to 1.6 is at least 65 percent by number, is more preferably at least 70 by number percent and is particularly preferably 100 by number percent.

When the ratio of toner particles which have said shape coefficient in the range of 1.0 to 1.6 is at least 65 percent, by number, the packing density of the toner layer transferred to a transfer material increases. As a result, fixing property is improved and offsetting is less likely to be caused. Furthermore, toner particles are not as likely to break down, decreasing staining on charging members, and stabilizing toner chargeability as well.

In the toner (C) the ratio of toner particles which have said shape coefficient being preferably in the range of 1.2 to 1.6 is at least 65 percent by number, and is in particular preferably at least 70 percent by number.

The shape coefficient can be controlled by adjusting temperature, time and stirring strength during salting/fusing process of the resin particles containing releasing agent and/or crystalline polyester and colorant particles.

The variation coefficient of the shape coefficient of the toner of the present invention is calculated by the formula below:

$$\text{Variation coefficient}=(S_1/K)\times 100 \text{ (in percent)}$$

wherein $S_1$ denotes the standard deviation of the shape coefficient of 100 toner particles, and K denotes the average of the shape coefficient.

The less the variation coefficient of the shape coefficient of the toner (A) and toner (C) becomes, the more preferable characteristics are obtained generally. Practically the variation coefficient of the shape coefficient of the toner (A) and toner (C) is not more than 16 percent, and is preferably not more than 14 percent. By maintaining the variation coefficient of the shape coefficient below 16 percent, voids in transferred toner layers decrease to improve fixing property as well as to minimize the formation of offsetting. Further, the charge amount distribution becomes narrower to improve overall image quality.

In order to uniformly control said toner shape coefficient as well as the variation coefficient of said toner shape coefficient so as to minimize lot fluctuations, during the process in which resin particles are subjected to polymerization, fusing, and shape controlling, the process may be appropriately terminated while monitoring properties of toner particles (tinted particles) which are being formed.

Monitoring as described herein means that process conditions are controlled based on measurements obtained by measurement devices incorporated into the production line. For example, when a toner is prepared employing the polymerization method in which resin particles are associated or fused in an aqueous medium, during the fusing process and the like, sampling is successively carried out to measure the shape as well as particle size, and when the targeted shape is obtained, the reaction is terminated.

The monitoring methods are not particularly limited, and a flow type particle image analyzer FPIA-2000 (manufactured by Toa Iyo Denshi Co.) may be used. Said device is suitably employed because shapes can be monitored in real-time from a flowing sample liquid. Namely, the particle shape and the like in a sample which is fed to said device from the reaction vessel, employing a pump, is continually monitored, and when the desired shapes are obtained, the reaction is terminated.

<Number Variation Coefficient>

The number particle size distribution as well as the number variation coefficient of the toner of the present invention is measured by either a Coulter Counter TA-II or a Coulter Multisizer (both are manufactured by Coulter Co.). In the present invention, the Coulter Multisizer was used, which was connected to a particle size distribution output interface (manufactured by Nikkaki), via a personal computer. An aperture employed in said Coulter Multisizer was 100 $\mu$m, and the volume as well as the number of toner particles with at least 2 $\mu$m was measured to calculate the particle size distribution as well as the average particle size. The number particle size distribution as described herein represents the relative frequency of toner particles with respect to the toner diameter, and the number average particle size represents the median diameter in the number particle size distribution.

The number variation coefficient in the number particle size distribution of toner is calculated by the formula described below:

$$\text{Number variation coefficient}=(S_2/D_n)\times 100 \text{ (in percent)}$$

wherein $S_2$ represents the standard deviation in the number particle size distribution, and $D_n$ represents the number average particle size (in $\mu$m).

The less number variation coefficient of the toner (A) and toner (B) becomes, the more preferable characteristics are obtained in general. The number variation coefficient of the toner (A) and toner (B) of the present invention is practically not more than 27 percent, and is preferably not more than 25 percent and not less than 8%. By controlling the number variation coefficient, voids in the transferred toner layer decrease to improve fixing property as well as to minimize offsetting. Further, the charge distribution narrows, and the transfer efficiency is enhanced, improving image quality.

Methods to control the number variation coefficient of the present invention are not particularly limited. For example, a method may be employed in which toner particles are classified employing forced airflow. However, in order to decrease the number variation coefficient, classification in liquid is more effective. Classifying methods in liquid include one in which a toner is prepared by classifying and collecting toner particles in response to the difference in sedimentation rate generated by the difference in particle size while controlling rotational frequency, employing a centrifuge.

In the toner (B) of the present invention, the ratio of toner particles having no corners is at least 50 percent by number, and is preferably at least 70 percent by number.

In the toner (A) and (C) of the present invention, the ratio of toner particles having no corners is at least 50 percent by number, is preferably at least 70 percent by number, and is particularly preferably 100% by number.

By controlling the ratio of toner particles having no corners at no less than 50 percent by number, voids in transferred toner layers decrease to improve fixing property as well as to minimize offsetting. Further, the number of toner particles, which are readily abraded or broken down and which have portions at which charge can be concentrated, decrease. As a result, charge amount distribution narrows and chargeability is stabilized, enabling formation of excellent image quality over a long period of time.

Toner particles having no corners, as described in the present invention, represent those which have substantially neither projected portions at which electric charges can concentrate nor which are readily abraded due to stress. Specifically, the toner particle described below is denoted as a toner having no corners. Namely, as shown in FIG. 1(*a*), when a circle having a radius of L/10, wherein L represents the longer diameter of a toner particle, is rolled within the circumferential edge of the toner particle while being in internal contact with the edge at one point, and when said circle does not substantially cross over the edge, said toner particle is denoted as a toner having no corners. "When said toner does not substantially cross over the edge" means that there is not more than one of the projected portions at which said circle crosses over the edge. The longer diameter of the toner particle as described herein means the maximum distance of the particle when the projected image of the particle on a screen is placed between two parallel lines. FIG. 1(*b*) and FIG. 1(*c*) show projected image of the toner particles having corners.

Said toner having no corners was measured as follows. First, a toner particle was magnified employing a scanning electron microscope and a photograph of said magnified particle was taken. The resulting photograph was further magnified to a magnification of 15,000 and a photographic image was obtained. Subsequently, employing the resulting photographic image, the presence of the above-mentioned corners was measured. Such measurement was carried out for 100 individual toner particles.

In a toner prepared employing the polymerization method in which the toner is prepared by associating or fusing resin particles, at the fusing terminating stage, the surface of a fused particle is highly rough and is not at all smooth. Toner having no corners is prepared by suitably controlling conditions such as the temperature, the rotational frequency of stirring blades, the stirring time, and the like, during the shape controlling process. These conditions may vary depending on the physical properties of resin particles. For example, the surface of toner smoothens by increasing the rotational frequency at a temperature higher than the glass transition point of said resin particles, and subsequently, a toner having no corners can be obtained.

<Particle Size of the Toner>

The particle size of the toner of the present invention is preferably 3 to 8 $\mu$m in terms of number average particle size. When toner articles are prepared employing the polymerization method, the resulting particle size may be controlled based on the concentration of a coagulant, the addition amount of organic solvents, the fusing time, and further, the composition of the polymer itself.

By controlling the number average particle size between 3 to 8 $\mu$m, the number of fine toner particles having a large adhesive force, which jump and adhere onto a heating member to cause offsetting, decreases, and furthermore, the transfer efficiency is enhanced to improve halftone image quality, and also to improve fine line and dot image quality.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in $\mu$m) represents the particle size of a toner particle, while being divided into a plurality of classes at intervals of 0.23, and the number of particles is used as an ordinate.

By maintaining the sum M of the relative frequency ml and the relative frequency m2 at no less than 70 percent, the variance of the particle size distribution of toner particles narrows. As a result, by employing said toner in an image forming process, the minimization of generation of selective development may be secured.

In the present invention, the above-mentioned histogram showing the particle size distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1,84 to 2.07, 2.07 to 2.30, 2.30 to 2.53, 2.53 to 2.76 . . . ), being based on the number of particles. Said histogram was prepared in such a manner that particle size data of a sample measured by a Coulter Multisizer according to conditions described below were transmitted to a computer via an I/O unit, so that in said computer, said histogram was prepared employing a particle size distribution analyzing program.

(Measurement Conditions)

Aperture: 100 $\mu$m

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

<Releasing Agent>

The toner of the invention comprises associated toner particles obtained by salting/fusing of resin particles containing a releasing agent in a biding resin and colored particles.

The releasing agent is a crystalline organic compound having a melting point of from 50 to 130° C. and melt viscosity of not more than 200 60 dPa·s at 160° C.

The releasing agent employed invention is preferably a specified crystalline ester compound (Specified Ester Compound) represented by the General Formula (1).

$$R^1—(OCO—R^2)_n \qquad \text{General Formula (1):}$$

wherein $R^1$ and $R^2$ each represent a hydrocarbon group having from 1 to 40 carbon atoms, which may have a substituent, and n is an integer of 1 to 4.

<Specified Ester Compound>

In the Formula (1), $R^1$ represents a hydrocarbon group which may have a substituent.

Number of the carbon atom of $R^1$ is from 1 to 40, preferably from 1 to 20, and preferably in particular from 2 to 5.

Number of the carbon atom of $R^2$ is from 1 to 40, preferably from 16 to 30, and preferably in particular from 18 to 26.

In the Formula n is an integer of from 1 to 4, preferably from 2 to 4, more preferably from 3 or 4 and in particular 4 is preferable.

Crystalline polyester compound which constitute the toner of the present invention may be suitably synthesized employing dehydration condensation reaction of alcohols with carboxylic acids.

Specific examples of specified compounds, which are employed in the toner of the present invention, include those represented by formulas 1) through 22).

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—C(CH_3)_2—CH_2—O—CO—(CH_2)_{22}—CH_3$

9) $CH_3—(CH_2)_{26}—COO—CH_2—C(CH_3)_2—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

-continued

11)

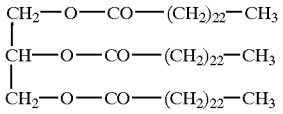

12)

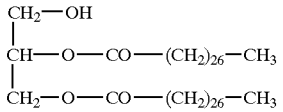

13)

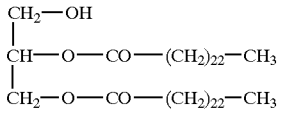

14)

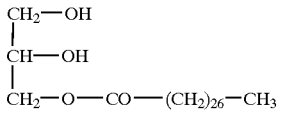

15)

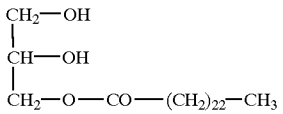

16)

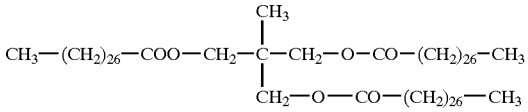

17)

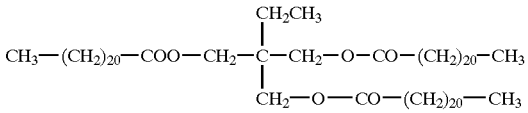

18)

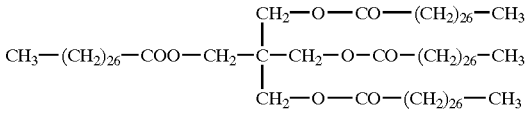

19)

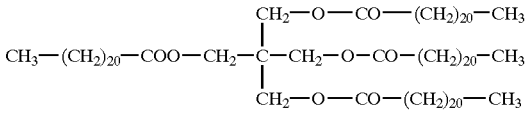

20)

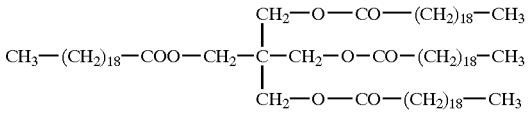

21)

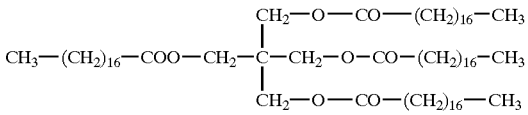

22)

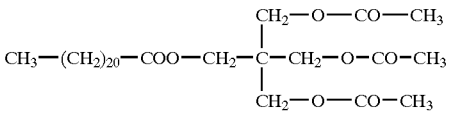

<Content Ratio of Specified Crystalline Compounds>

The content ratio of the releasing agents in the toner of the present invention is commonly from 1 to 30 percent by weight, is preferably from 2 to 20 percent by weight, and is more preferably from 3 to 15 percent by weight.

<Crystalline Polyester>

In another embodiment the toner comprises associated toner particles obtained by salting/fusing of resin particles containing a crystalline polyester compound in a biding resin and colored particles.

The crystalline polyester compound incorporated in the resin particles reduces viscoelasticy of the toner in fixing process, and give a good fixing ability (that is adhesiveness to an image forming material) to the toner which is obtained by fusing the resin particles.

(Physical Properties of Crystalline Polyester)

The melting point of crystalline polyester described above is preferably between 50 and 130° C., and is more preferably between 60 and 120° C.

When crystalline materials, having a melting point in the range of 50 to 130° C., are employed, it is possible to lower the entire melt viscosity of the obtained toner, and it is also possible to attempt the enhancement of adhesion to paper and the like. In addition, even though said crystalline materials are present, the elastic modulus on the high temperature side is maintained in the preferred range. Thus excellent offset resistant properties are exhibited. When the melting point of crystalline materials is less than 50° C., fixability is improved. However, commercially unviable problems occur due to the degradation of storage stability. On the other hand, when the melting point exceeds 130° C., contribution to the enhancement of fixability decreases due to an increase in the melt initiation temperature. Thus reduced effect for the improvement of fixability is exhibited.

The melting point of crystalline materials, as described herein, means the value measured by a differential scanning calorimeter (DSC). Specifically, when temperature increases at a rate of 10° C./minute from 0 to 200° C., the temperature, which shows the maximum peak of measured endothermic peaks, is designated as the melting point. Cited as a specific measurement apparatus may be DSC-7 manufactured by Perkin-Elmer Corp.

The number average molecular weight of crystalline materials is preferably between 1,500 and 15,000, and is more preferably between 2,000 and 10,000. In the toner obtained employing crystalline materials having a number average molecular weight of 1,500 to 15,000, compatibility with amorphous polymers which are employed to realize a total decrease in the melt viscosity is improved in a molten state, and thus the fixability in the lower temperature range is enhanced. When said number average molecular weight is less than 1,500, the melt viscosity of said crystalline materials becomes excessively low, and on the contrary, the compatibility state tends to be non-uniform. As a result, it becomes difficult to enhance the desired fixability. On the other hand, when the number average molecular weight exceeds 15,000, it takes extra time to melt the crystalline materials, and the compatibility state also becomes non-uniform. Thus, effects to enhance the fixability are insufficient.

Condition

Model of machine employed: LC-6 A (manufactured by Shimadzu Corp.)

Column: Ultrastyragel Plus

Analysis temperature: 60° C.

Solvent: m-cresol/chlorobenzene 3/1 (volume ratio)

Calibration curve: Standard polystyrene calibration curve

It is preferable that melt viscosity of a crystalline material (viscosity at melting point plus 20 degrees) is not more than 100 dPa·s and more preferably not more than 60 dPa·s.

When a crystalline material having melt viscosity of less than 100 dPa·s is employed, melt viscosity as a whole including the amorphous polymer can be lowered, and fixing ability improves in provided toner.

Improvement effect of fixing ability deteriorates because total melt viscosity becomes high when the melt viscosity exceeds 100 dPa·s.

Melt viscosity of a crystalline material is preferably not less than 8 dPa·s in view of preventing deterioration due to long time storage.

Melt viscosity of a crystalline material (viscosity by melting point plus 20 degrees) means a value measured by a cone plate viscometer.

Peak molecular weight of the crystalline material measured by GPC is with 6,000–50,000.

Crystalline polyester composing the toner in accordance with the present invention generally exhibits an endothermic peak (P1) in the range of 50 to 130° C. during the first temperature rising stage, as measured with a DSC, and more preferably exhibits the same in the range of 60 to 120° C.

Further, said crystalline materials exhibit an exothermic peak (P2) in the range of 30 to 110° C. during the first cooling process, employing a DSC, and preferably exhibit the same in the range of 40 and 100° C.

Herein, the relationship of P1≧P2 is held between the endothermic peak (P1) and the exothermic peak (P2) The temperature difference (P1–P2) is not particularly limited, but is preferably not more than 50° C.

By incorporating the crystalline materials having thermal properties as described above as the resinous component into toner, as can clearly be seen from the results of examples described below, it is possible to exhibit excellent offset resistant effects (a wider fixable temperature range) as well as excellent fixability (high fixing ratio).

It is preferable that the amorphous polymers and the crystalline materials preferably exist in a state independent of each other. Namely, said crystalline materials abruptly melt and the resulting molten state exhibits an action to dissolve the amorphous polymers. As a result, it is possible to decrease the entire melt viscosity of the toner, and thus it is possible to enhance the fixability. Further, by allowing both to be present independent of each other, it becomes possible to minimize the decrease in the elastic modulus. As result, the offset resistance is not degraded.

When the endothermic peak (P1) is less than 50° C., fixability is enhanced due to the low melting temperature, while offset resistant properties as well as storage stability are degraded.

Further, when the endothermic peak (P1) exceeds 130° C., a compatibility temperature with the amorphous polymer increases due to the high melting temperature. As a result, it is impossible to realize the enhancement of the fixability.

When an exothermic peak (P2), showing a recrystallization state, is present in the range of less than 30° C., it is impossible to carry our recrystallization without cooling to a fairly low temperature. Such a substance is to be present in the toner in the low crystallizing state, which is not capable of contributing to the enhancement of fixability.

Further, when an exothermic peak (P2) exists in the range exceeding 110° C., the recrystallization temperature is excessively high. As a result, the so-called fusing temperature becomes higher, and the low temperature fixability is degraded.

The endothermic peak (P1), as well as the exothermic peak (P2), is measured employing a differential scanning calorimeter (DSC) . Heating and cooling conditions are as follows. After resting at 0° C. for one minute, temperature is increased at a rate of 10° C./minute up to 200° C., and a maximum endothermic peak measured during the increase in temperature is designated as P1. Then after resting at 200° C. for one minute, the temperature is decreased at a rate of 10° C./minute, and the temperature which shows the maximum exothermic peak, measured during the decrease in temperature, is designated as P2. Cited as a specific apparatus may be DSC-7 manufactured by Perkin-Elmer Corp.

<The Crystalline Polyester Composition>

As a compound constituting crystalline polyester obtained by reaction of aliphatic diol with an aliphatic dicarboxylic acid (acid anhydride and acid chloride are included) is preferable.

Example of the diol which is used in order to obtain crystalline polyester includes ethylene glycol, diethylene glycol, triethylene glycol, 1,2-propylene glycol, 1,3-propylene glycol, 1,4-butane diol, 1,4-butene diol, neopentyl glycol, 1,5-pentane glycol, 1,6-hexane glycol, 1,4-cyclohexane diol, 1,4-cyclohexane di methanol, dipropylene glycol, polyethylene glycol, polypropylene glycol, poly tetramethylene glycol, bisphenol A, bisphenol Z, and hydrogenated bisphenol A.

As the dicarboxylic acid which is use in order to obtain crystalline polyester and crystalline polyamide, oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecyl succinic acid, n-dodecenyl succinic acid, iso dodecyl succinic acid, iso dodecenyl succinic acid, n-octyl succinic acid, n-octenyl succinic acid, and these acid anhydride or an acid chloride can be mentioned.

In particular as a preferable crystalline material, polyester obtained by reacting cyclohexane diol or 1,4-cyclohexanedimethanol with adipic acid, polyester obtained by reacting 1,6-hexanediol or 1,4-cyclohexane dimethanol with sebacic acid, polyester obtained by reacting ethylene glycol and succinic acid, polyester obtained by reacting ethylene glycol and sebacic acid, polyester obtained by reacting 1,4-butanediol and succinic acid can be mentioned. Among these, the polyester obtained by reacting cyclohexane diol, 1,4-cyclohexanedimethanol and adipic acid is particularly preferable.

<Ratio of Crystalline Polyester>

As a containing ratio of crystalline polyester in the toner, it is preferable that crystalline polyester is 1–50 weight parts, and more preferably 5–40 weight part, and in particular 5–30 weight parts.

<Resin Particles Containing Releasing Agent/Resin Particles Containing Crystalline Polyester>

The resin particles containing a releasing agent can be obtained as latex particles by dissolving the releasing agent in a monomer to obtain the binding resin, dispersing the monomer solution in an aqueous dispersant, and then processing polymerization.

The resin particles containing crystalline polyester can be obtained as latex particles by dissolving the crystalline polyester in a monomer to obtain the binding resin, dispersing the monomer solution in an aqueous dispersant, and then processing polymerization.

Weigh average particle size of these resin particles is preferably 10 to 2,000 nm.

Polymerization method to obtain the resin particles containing releasing agent and/or a crystalline polyester includes particle forming polymerization, such as emulsion polymerization, suspension polymerization, and seed polymerization.

The following method (hereinafter referred to as an "mini-emulsion method") may be cited as a preferable polymerization method to obtain resinous particles comprising releasing agent and/or a crystalline polyester. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding said water-soluble polymerization initiators, or along with said water-soluble polymerization initiators, oil-soluble polymerization initiators may be added to said monomer solution.

Herein, homogenizers which results in oil droplets in water dispersion, utilizing mechanical force, are not particularly limited, and may include "Clearmix" (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally 10 to 1,000 nm, and is preferably 30 to 300 nm.

<Binding Resins>

Binding resins, which constitute the toner of the present invention, preferably comprise high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

Herein, the method for measuring the molecular weight of resins, employing GPC, is as follows. Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

The composition materials of resinous particles and the preparation thereof will now be described.

(Monomers)

Of polymerizable monomers which are employed to prepare resinous particles, radical polymerizable monomers are essential components, and if desired, crosslinking agents may be employed. Further, at least one of said radical polymerizable monomers having an acidic group or radical polymerizable monomers having a basic group, described below, is preferably incorporated.

(1) Radical Polymerizable Monomers

Radical polymerizable monomers are not particularly limited. It is possible to employ conventional radical polymerizable monomers known in the art. Further, they may be employed in combination of two or more types so as to satisfy desired properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as (meth)acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Radical Polymerizable Monomers Having an Acidic Group or a Basic Group

Employed as radical polymerizable monomers having an acidic group or a basic group may, for example, be amine based compounds such as monomers having a carboxyl group, monomers having a sulfonic acid group, and amine based compounds such as primary, secondary, and tertiary amines, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like as monomers having a carboxyl group.

Listed as monomers having sulfonic acid are styrenesulfonic acid, allylsulfosuccinic acid, octyl allylsulfosuccinate, and the like.

These may be in the form of salts of alkali metals such as sodium or potassium, or salts of alkali earth metals such as calcium and the like.

Listed as radical polymerizable monomers having a basic group are amine based compounds which include dimethyl aminoethyl acrylate, dimethyl aminoethyl methacrylate, diethyl aminoethyl acrylate, diethyl aminoethyl methacrylate, and quaternary ammonium salts of said four compounds; 3-dimethylaminophenyl acrylate, 2-hydroxy-3-methacryloxypropyltrimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride, N,N-diallylethylammonium chloride; and the like.

The content ratio of radical polymerizable monomers having an acidic group or a basic group is preferably from 0.1 to 15 percent by weight with respect to the total monomers. The content ratio of radical polymerizable crosslinking agents is preferably from 0.1 to 10 percent by weight with respect to the total radical polymerizable monomers.

(Chain Transfer Agents)

For the purpose of regulating the molecular weight of resinous particles, it is possible to employ commonly used chain transfer agents.

Said chain transfer agents are not particularly limited, and for example, employed are mercaptans such as octylmercaptan, dodecylmercaptan, tert-dodecylmercaptan, and the like, carbon tetrabromide, styrene dimer, and the like.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at least room temperature.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, potassium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

<Colorants>

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

Employed as said organic pigments and dyes may be those conventionally known in the art. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I Solvent Blue 25, 36, 60, 70, 93, and 95; and the like. Further these may be employed in combination.

If desired, these organic pigments, as well as dyes, may be employed individually or in combination of selected ones.

Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Employed as fine inorganic particles may be those conventionally known in the art. Specifically, it is possible to preferably employ fine silica, titanium, and alumina particles and the like. These fine inorganic particles are preferably hydrophobic. Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-50OBS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle size of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

The toner of the present invention is a coalesced type toner obtained by salting out/fusion-adhering resinous particles comprising releasing agents and colorant particles in a water based medium. By salting out/fusion-adhering said resinous particles comprising releasing agents, as described above, a toner is obtained in which said releasing agents are finely depressed.

In addition, the toner of the present invention possesses an uneven surface from the production stage, and a coalesced type toner is obtained by fusing resinous particles and colorant particles. Therefore, differences in the shape as well as surface properties among toner particles are minimal. As a result, the surface properties tend to be uniform. Thus difference in fixability among toner particles tends to be minimized so that it is possible to maintain excellent fixability.

<Toner Production Process>

One example of the method for producing the toner of the present invention is as follows:

(1) a dissolution process in which releasing agents are dissolved in monomers and a monomer solution is prepared
(2) a dispersion process in which the resulting monomer solution is dispersed into a water based medium
(3) a polymerization process in which the resulting water based dispersion of said monomer solution undergoes polymerization so that a dispersion (latex) of resinous particles comprising said releasing agents is prepared
(4) a salting out/fusion-adhering process in which the resulting resinous particles and said colorant particles are subjected to salting out/fusion-adhering in a water based medium so as to obtain coalesced particles (toner particles)
(5) a filtration and washing process in which the resulting coalesced particles are collected from the water based medium employing filtration, and surface active agents and the like are removed from said coalesced particles
(6) a drying process in which washed coalesced particles are dried, and
(7) an external addition process may be included in which external agents are added to the dried coalesced particles.

(Dissolution Process)

Methods for dissolving releasing agents in monomers are not particularly limited.

The dissolved amount of said releasing agents in said monomers is determined as follows: the content ratio of releasing agents is generally 1 to 30 percent by weight with respect of the finished toner, is preferably 2 to 20 percent by weight, and is more preferably 3 to 15 percent by weight.

Further, oil-soluble polymerization initiators as well as other oil-soluble components may be incorporated into said monomer solution.

(Dispersion Process)

Methods for dispersing said monomer solution into a water based medium are not particularly limited. However, methods are preferred in which dispersion is carried out employing mechanical force. Said monomer solution is preferably subjected to oil droplet dispersion (essentially an embodiment in a mini-emulsion method), employing mechanical force, especially into a water based medium prepared by dissolving a surface active agent at a concentration of lower than its critical micelle concentration.

Herein, homogenizers to conduct oil droplet dispersion, employing mechanical forces, are not particularly limited, and include, for example, "Clearmix", ultrasonic homogenizers, mechanical homogenizers, and Manton-Gaulin homogenizers and pressure type homogenizers. Further, the diameter of dispersed particles is 10 to 1,000 nm, and is preferably 30 to 300 nm.

(Polymerization Process)

In the polymerization process, polymerization methods (granulation polymerization methods such as an emulsion polymerization method, a suspension polymerization method, and a seed polymerization method), which are conventionally known in the art, may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

(Salting Out/Fusion-adhering Process)

In the salting out/fusion-adhering process, a colorant particle dispersion is added to a dispersion comprised of resinous particles obtained by said polymerization process so that said resinous particles and said colorant particles are subjected to salting out/fusion-adhering in a water based medium.

Further, in said salting out/fusion-adhering process, resinous particles as well as colorant particles may be fused with internal agent particles and the like.

A resin particle containing no releasing agent or crystalline polyester compound can be subjected to fusion-adhering together with the resin particle containing the releasing agent and/or the crystalline polyester compound in the process of salting out/fusion-adhering.

A resin particle having middle molecular weight polymer containing the releasing agent and/or the crystalline polyester compound, a resin particle having low molecular weight polymer, a resin particle having high molecular weight polymer and colored particle are subjected to salting out/fusion-adhering in one of the preferable embodiment.

By employing the releasing agent and/or the crystalline polyester compound incorporated in the middle molecular weight polymer only, excellent anti-off set ability and fixing ability are available due to the resin particle having middle molecular weight polymer and further, anti-off set ability and anti-winding ability due to the resin particle having high molecular weight polymer and suitable fixing ability due to resin particle having low molecular weight polymer are not deteriorated.

"Water based medium", as described in said salting out/fusion-adhering process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting out/fusion-adhering process by dispersing colorants into a water based medium. Dispersion of colorants is carried out in such a state that the concentration of surface active agents in water is adjusted to at least critical micelle concentration (CMC).

Homogenizers to disperse colorants are not particularly limited, and preferably listed are "Clearmix", ultrasonic homogenizers, mechanical homogenizers, Manton-Gaulin and pressure type homogenizers, and medium type homogenizers such as sand grinders, Getman mill, diamond fine mills and the like. Further, listed as surface active agents may be the same as those previously described.

Further, colorants (particles) may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifiers.

The salting out/fusion-adhering process is accomplished as follows. Salting-out agents, comprised of alkaline metal salts and/or alkaline earth metal salts and the like, are added to water comprising resinous particles as well as colorant particles as the coagulant at a concentration of higher than critical aggregation concentration. Subsequently, the resulting aggregation is heated above the glass transition point of said resinous particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as said organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than 3 carbon atoms.

In the salting out/fusion-adhering process, it is preferable that hold-over time after the addition of salting-out agents is as short as possible. Namely it is preferable that after the addition of salting-out agents, a dispersion comprised of resinous particles and colorant particles is heated as soon as possible and heated to a temperature higher than the glass transition point of said resinous particles.

The reason for this is not well understood. However, problems occur in which the aggregation state of particles varies depending on the hold-over time after salting out so that the particle size distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resinous particles.

Further, it is required that in the salting out/fusion-adhering process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting out/fusion-adhering, said rate is preferably not more than 15° C./minute.

Further, after the dispersion comprised of resinous particles and colorant particles is heated to a higher temperature than said glass transition point, it is important to continue the salting out/fusion-adhering by maintaining the temperature of said dispersion for a specified period of time. By so doing, it is possible to effectively proceed with the growth of toner particles (aggregation of resinous particles as well as colorant particles) and fusion (disappearance of the interface between particles. As a result, it is possible to enhance the durability of the finally obtained toner.

Further, after terminating the growth of coalesced particles, fusion by heating may be continued.

(Filtration and Washing)

In said filtration and washing process, carried out is filtration in which toner particles are collected from the toner particle dispersion obtained by the process previously described, and adhered materials such as surface active agents, salting-out agents, and the like, are removed from the collected toner particles (a caked aggregation).

Herein, the filtration methods are not particularly limited, and include a centrifugal separation method, a vacuum filtration method which is carried out employing glass filter and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably be employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to pulverization treatment. Herein, employed as pulverization devices may be mechanical pulverization devices such as a jet mill, a Henschel mixer, a coffee mill, a food processor, and the like.

(Addition Process of External Additives)

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

Besides colorants and releasing agents, materials, which provide various functions as toner materials may be incorporated into the toner of the present invention. Specifically, charge control agents are cited. Said agents may be added employing various methods such as one in which during the salting out/fusion-adhering stage, said charge control agents are simultaneously added to resinous particles as well as colorant particles so as to be incorporated into the toner, another is one in which said charge control agents are added to resinous particles, and the like.

In the same manner, it is possible to employ various charge control agents known in the art, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

The toner of the present invention is suitably employed to form semi-gloss images.

The "semi-gloss images", as described herein, refer to images having a standard glossiness of 17 to 37. The standard glossiness, as described in the present invention, is represented by a value determined in such a manner that an image area, in which an image forming material (toner) covers at least 90 percent of the image forming support, is measured at an incident angle of 75 degrees, employing a gloss meter VGS-lD (produced by Nihon Denshoku Kogyo Co., Ltd.) in accordance with JIS-Z8741-1983. The covering ratio of said image forming material on said image forming material was determined employing a high speed color image analysis apparatus SPICCA (produced by Nihon Avionics Co.).

In the present invention, the standard glossiness of the semi-gloss images is 17 to 37, and is preferably to be 17 to 27. When the standard glossiness is less than 17, images lack brightness and sufficient sensation of quality is not obtained. On the other hand, when the standard glossiness exceeds 37, reflection light from the front surface becomes excessive, and sufficient sensation of quality is not obtained, as well as realism is insufficient. Further, when the surface is smooth, the amount of incident light into the interior becomes greater, and colorants tend to be degraded and image degradation develops during storage. In order to minimize the degradation of colorants, it is specifically preferable that the standard glossiness be not more than 27.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 $\mu$m are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle size of said magnetic particles is preferably 15 to 100 $\mu$m, and is more preferably 25 to 80 $\mu$m.

The volume average particle size of said carrier can be generally determined employing a laser diffraction type particle size distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

The toner of the present invention is employed preferably in an image forming method comprising a fixing process employing a fixing unit composed of a heating roller and a pressure roller through which fixing is conducted.

Figure 2:
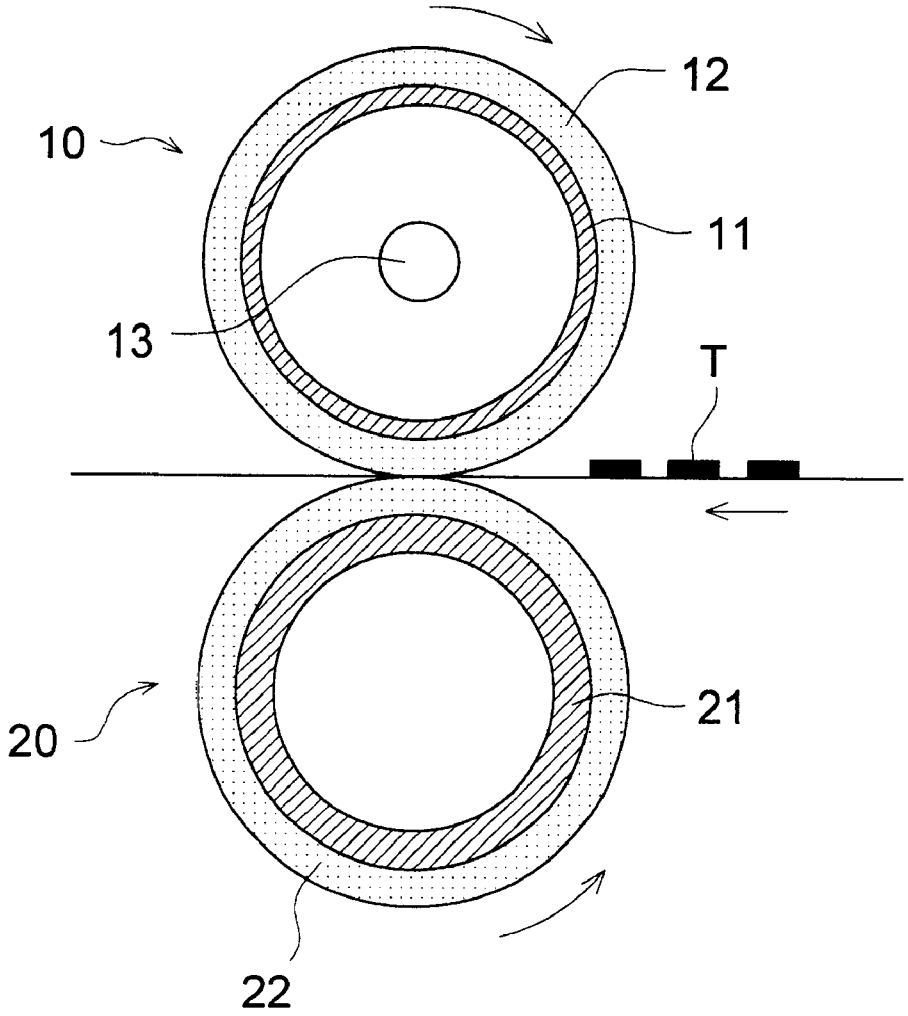
FIG. 2 is cross section view of an example of the fixing device employed in the invention.

FIG. 2 is a cross-sectional view showing an example of a fixing unit employed in the present invention. The fixing unit shown in FIG. 2 comprises heating roller 10 and pressure roller 20 which is brought into contact with said heating roller 10. Further, in FIG. 2, T is a toner image formed on a sheet of transfer paper (an image forming support).

Heating roller 10 comprises cylinder 11 having thereon covering layer 12 comprised of fluorine resins and includes heating member 13 comprised of a linear heater.

Said cylinder 11 is comprised of metal and its interior diameter is 10 to 70 mm. Metals which constitute cylinder 11 are not particularly limited, and include, for example, metals such as iron, aluminum, copper, and the like, and alloys thereof.

The wall thickness of cylinder 11 is 0.1 to 15 mm, and preferably 0.1 to 2 mm, and is determined while taking into account the balance between the demand of energy saving (by a decrease in thickness) and strength (dependent on the composition materials). For example, the some strength resulting from an iron cylinder having a wall thickness of 0.57 mm is obtained by an aluminum cylinder having a wall thickness of 0.8 mm.

Exemplified as fluorine resins constituting covering layer 12 may be PTFE (polytetrafluoroethylene), PFA (tertafluoroethylene-perfluoroalkyl vinyl ether copolymers), and the like.

The thickness of covering layer 12 is commonly 10 to 500 μm, and is preferably 20 to 400 μm.

When the thickness of covering layer 12 is less than 10 μm, it is impossible to allow said covering layer 12 to sufficiently exhibit the function as the covering layer, and also it is impossible to obtain the durability as a fixing unit. On the other hand, the surface of the covering layer having a thickness of no less than 500 μm tends to be abraded due to paper dust. Then, a toner adheres to said abrasion to result in problems with image staining.

The elastic material forming a covering layer 12 includes silicone rubber or silicone sponge, which has good heat resistance, such as LTV, RTV and HTV.

An Asker C harness of the elastic material covering layer 12 is less than 80 degrees, preferably less than 80 degrees. The thickness of the elastic material covering layer 12 is 0.1 to 30 mm.

When the Asker C hardness of elastic materials constituting covering layer 12 exceeds 80 degrees, as well as when the thickness of the covering layer is less than 0.1 mm, it is impossible to increase the fixing nip. Accordingly it is impossible to exhibit effects of soft fixing (for example, improvement of color reproduction by toner layer at a leveled interface).

Halogen heaters may be suitably employed as heating member 13.

Pressure roller 20 comprises cylinder 21 having on its surface covering layer 22 comprised of elastic materials. Elastic materials constituting covering layer 22 are not particularly limited, and may include various types of soft rubber such as urethane rubber, silicone rubber, and the like, and also foamed rubber. Silicone rubber as well as silicone sponge rubber is preferably employed, which is exemplified as those constituting covering layer 12.

The Asker C hardness of elastic materials, constituting covering layer 22, is commonly less than 80 degrees, is preferably less than 70 degrees, and is more preferably less than 60 degrees.

Further, the thickness of covering layer 22 is commonly 0.1 to 30 mm, and is preferably 0.1 to 20 mm.

When the Asker C hardness of elastic materials constituting covering layer 22 exceeds 80 degrees, as well as when the thickness of the covering layer is less than 0.1 mm, it is impossible to increase the fixing nip. Accordingly it is impossible to exhibit effects of soft fixing.

Materials constituting cylinder 21 are not particularly limited, and may include metals such as aluminum, iron, copper, and the like, and alloys thereof.

The contact load (total load) of heating roller 10 applied to pressure roller 20 is commonly 40 to 350 N, is preferably 50 to 300 N, and is more preferably 50 to 250 N. Said load is set taking into the strength (the wall thickness of cylinder 11) of heating roller 10. For example, when a heating roller comprised of an iron cylinder having a wall thickness of 0.3 mm is employed, the applied load is preferably not more than 250 N.

Further, from the viewpoint of offsetting resistance as well as fixability, nip width is preferably 4 to 10 mm, and the surface pressure of said nip is preferably $0.6\times10^5$ to $1.5\times10^5$ Pa.

When the fixing unit shown in FIG. 2 is employed, an example of fixing conditions are as follows: fixing temperature (surface temperature of heating roller 10) is 150 to 210° C., and fixing linear speed is 80 to 640 mm/second.

A fixing unit may be provided with said cleaning mechanism. Employed as cleaning systems are a system in which various types of silicone oil are supplied to a fixing film, or a system which carries out cleaning, employing a pad impregnated with silicone oil, a roller, a web and the like.

Silicone oil having high resistance to heat, for example, polydimethylsilicone, polymethylphenylsilicone etc. are employed. The silicone oil having a viscosity of 10 Pa·s at 20° C. is preferably employed because those having low viscosity is provided in excess.

Specifically, the present invention exhibits marked effects for a system in which none or a definite amount of silicone oil is used. Therefore, it is preferable to provide not more than 2 mg/A4 size sheet in case the oil is employed.

An amount of the silicone oil adhered to an image forming sheet is reduced by suppressing not more than 2 mg/A4 size sheet, and as the result, it does not hinder to write the sheet by oily pen such as ball pen. Further deterioration of off-set resistance due to denature of silicone oil according to time lapsing, contamination of optical system or charging electrodes by silicone oil can be avoided.

The providing amount of silicone oil is calculated by measuring the mass difference of fixing device (Δw) before and after putting 100 sheets of A4 size sheet through rollers of the fixing device continuously (Δw/100).

EXAMPLES

The present inventing will now be detailed with reference to examples.

Preparation Example HP-1

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (sodium dodecylbenzenesulfonate: SDS) in 2,760 g of deionized water, and the interior temperature was raised to 80° C. under a nitrogen gas flow while stirring at 230 rpm.

Subsequently, a solution prepared by dissolving 0.42 g of a polymerization initiator potassium persulfate (KPS) in 200 g of deionized water was added to the surface active agent solution and it was heated at 75° C., a monomer mixture solution consisting of 115.1 g of styrene, 42.0 g of n-butyl acrylate, and 10.9 g of methacrylic acid was added dropwise over 1 hour. The mixture underwent polymerization by stirring for 2 hours at 75° C. Thus latex (a dispersion comprised of higher molecular weight resin particles) was obtained. The resulting latex was designated as Latex (HP-1).

The polymers composed of resin particles composing the Latex (HP-1) has peak at molecular weight of 518,000,and weight average molecular weight of the composite resin particles was 105 nm.

Preparation Example HP-2

Latex (a dispersion comprised of higher molecular weight resin particles) was prepared in the same way as Preparation Example HP-1, except that the reaction temperature was varied to 75° C. The resulting latex was designated as Latex (HP-2).

The polymers composed of resin particles composing the Latex (HP-2) has peak at molecular weight of 421,000,and weight average molecular weight of the composite resin particles was 110 nm.

Preparation Example HP-3

Latex (a dispersion comprised of higher molecular weight resin particles) was prepared in the same way as Preparation Example HP-1, except that the amount of the initiator (KPS) was modified to 0.84 g. The resulting latex was designated as Latex (HP-3).

The polymers composed of resin particles composing the Latex (HP-3) has peak at molecular weight of 316,000,and weight average molecular weight of the composite resin particles was 110 nm.

Preparation Example HP-4

Latex (a dispersion comprised of higher molecular weight resin particles) was prepared in the same way as Preparation Example HP-1, except that the amount of the initiator (KPS) was modified to 0.84 g and the temperature to 90° C. The resulting latex was designated as Latex (HP-4).

The polymers composed of resin particles composing the Latex (HP-3) has peak at molecular weight of 193,000,and weight average molecular weight of the composite resin particles was 110 nm.

Preparation Example MP-1

A monomer solution was prepared in such way that 72.0 g of Exemplified Compound 19) was added to monomer mixture solution consisting of 383.6 g of styrene, 140.0 g of n-butyl acrylate, 36.4 g of methacrylic acid, 5.6 g of n-octyl-3-mercaptopropionic acid ester and the mixture was heated to 80° C. to melt the monomers in a flask equipped with a stirrer.

Placed into a 5,000 ml separable flask fitted with a stirring unit, a temperature sensor, a cooling pipe, and a nitrogen gas inlet was a surface active agent solution (water based medium) prepared by dissolving 1.6 g of an anionic surface active agent (sodium dodecylbenzenesulfonate: SDS) in 2,000 g of deionized water, and the interior temperature was raised to 80° C.

Then a dispersion of emulsion particles (oil droplet) having homogeneous particle size was prepared by dispersing the monomer solution mentioned above at 80° C. in the surfactant solution mentioned above at 80° C. by employing mechanical dispersion machine, "Clearmix" (produced by M Technique Ltd.) equipped with circulating pass.

Subsequently, latex (a dispersion of middle molecular weight resin particles containing the Exemplified Compound 19) was obtained in such way that a solution prepared by dissolving 19.1 g of a polymerization initiator potassium persulfate (KPS) in 240 g of deionized water, and 750 g of deionized water were added to the dispersion and it underwent polymerization by stirring and heated at 80° C. for 3 hours. The resulting latex was designated as Latex (MP-1).

The polymers composed of resin particles composing the Latex (MP-1) has peak at molecular weight of 103,000,and weight average molecular weight of the composite resin particles was 108 nm.

Preparation Example MP-2

Latex (a dispersion of middle molecular weight resin particles containing the Exemplified Compound 19) was obtained in the same way as Preparation Example MP-1, except that the amount of dodecylmercaptan was modified to 8.3 g. The resulting latex was designated as Latex (MP-2).

The polymers composed of resin particles composing the Latex (MP-2) has peak at molecular weight of 81,000, and weight average molecular weight of the composite resin particles was 110 nm.

Preparation Example MP-3

Latex (a dispersion of middle molecular weight resin particles containing the Exemplified Compound 19) was obtained in the same way as Preparation Example MP-1, except that the amount of the Exemplified Compound 19) was modified to 144.0 g. The resulting latex was designated as Latex (MP-3).

The polymers composed of resin particles composing the Latex (MP-3) has peak at molecular weight of 103,000, and weight average molecular weight of the composite resin particles was 115 nm.

Preparation Example MP-4

Latex (a dispersion of middle molecular weight resin particles containing the Exemplified Compound 21) was obtained in the same way as Preparation Example MP-1, except that 72.0 g of the Exemplified Compound 21) was added to the monomer mixture in place of the Exemplified Compound 19). The resulting latex was designated as Latex (MP-4).

The polymers composed of resin particles composing the Latex (MP-3) has peak at molecular weight of 102,000, and weight average molecular weight of the composite resin particles was 110 nm.

Preparation Example MP-5

Latex (a dispersion of middle molecular weight resin particles containing the Exemplified Compound 18) was obtained in the same way as Preparation Example MP-1, except that 72.0 g of the Exemplified Compound 18) was added to the monomer mixture in place of the Exemplified Compound 19). The resulting latex was designated as Latex (MP-5).

The polymers composed of resin particles composing the Latex (MP-5) has peak at molecular weight of 102,000, and weight average molecular weight of the composite resin particles was 110 nm.

Preparation Example MP-6

Latex (a dispersion of middle molecular weight resin particles containing the crystalline polyester (1) was obtained in the same way as Preparation Example MP-1, except that 80.0 g of the crystalline polyester (1) was added to the monomer mixture in place of the Exemplified Compound 19). The resulting latex was designated as Latex (MP-6).

The polymers composed of resin particles composing the Latex (MP-6) has peak at molecular weight of 105,000, and weight average molecular weight of the composite resin particles was 110 nm.

Preparation Example MP-7

Latex (a dispersion of middle molecular weight resin particles containing the crystalline polyester (1) was obtained in the same way as Preparation Example MP-6, except that the amount of dodecylmercaptan was modified to 8.3 g. The resulting latex was designated as Latex (MP-7).

The polymers composed of resin particles composing the Latex (MP-7) has peak at molecular weight of 79,000, and weight average molecular weight of the composite resin particles was 110 nm.

Preparation Example MP-8

Latex (a dispersion of middle molecular weight resin particles containing the crystalline polyester (2) was obtained in the same way as Preparation Example MP-6, except that 80.0 g of the crystalline polyester (2) shown in Table 1 described later was added to the monomer mixture in place of the crystalline polyester (1). The resulting latex was designated as Latex (MP-8).

The polymers composed of resin particles composing the Latex (MP-7) has peak at molecular weight of 104,000, and weight average molecular weight of the composite resin particles was 115 nm.

Preparation Example MP-9

Latex (a dispersion of middle molecular weight resin particles containing the crystalline polyester (3) was obtained in the same way as Preparation Example MP-6, except that 80.0 g of the crystalline polyester (3) shown in Table 1 described later was added to the monomer mixture in place of the crystalline polyester (1). The resulting latex was designated as Latex (MP-8).

The polymers composed of resin particles composing the Latex (MP-7) has peak at molecular weight of 104,000, and weight average molecular weight of the composite resin particles was 110 nm.

Preparation Example MP-10

Latex (a dispersion of middle molecular weight resin particles containing the crystalline polyester (4) was obtained in the same way as Preparation Example MP-6, except that 80.0 g of the crystalline polyester (4) shown in Table 1 described later was added to the monomer mixture in place of the crystalline polyester (1). The resulting latex was designated as Latex (MP-10).

The polymers composed of resin particles composing the Latex (MP-7) has peak at molecular weight of 101,00, nand weight average molecular weight of the composite resin particles was 110 nm.

Preparation Example MP-11

Latex (a dispersion of middle molecular weight resin particles containing the crystalline polyester (5) was obtained in the same way as Preparation Example MP-6, except that 80.0 g of the crystalline polyester (5) shown in Table 1 described later was added to the monomer mixture in place of the crystalline polyester (1). The resulting latex was designated as Latex (MP-8).

The polymers composed of resin particles composing the Latex (MP-7) has peak at molecular weight of 100, OOO, and weight average molecular weight of the composite resin particles was 110 nm.

Preparation Example MP-12

Latex (a dispersion of middle molecular weight resin particles containing the crystalline polyester (1) was obtained in the same way as Preparation Example MP-6, except that amount of the crystalline polyester (1) shown is modified to 90.0 g. The resulting latex was designated as Latex (MP-12).

The polymers composed of resin particles composing the Latex (MP-12) has peak at molecular weight of 103,000, and weight average molecular weight of the composite resin particles was 110 nm.

Preparation Example MP-13

Latex (a dispersion of middle molecular weight resin particles containing the crystalline polyester (1) was obtained in the same way as Preparation Example MP-6, except that amount of the crystalline polyester (1) shown is modified to 70.0 g. The resulting latex was designated as Latex (MP-13).

The polymers composed of resin particles composing the Latex (MP-13) has peak at molecular weight of 107,000, and weight average molecular weight of the composite resin particles was 110 nm.

TABLE 1

| Crystalline Polyester | Raw Material: Diol | Raw Material: Di-carboxylic acid | Endothermic Peak P1) | Endothermic Peak P2) | Number Average Molecular Weight (Mn) | Melt Viscosity (at melting point plus 20° C.) (dPa · s) |
|---|---|---|---|---|---|---|
| (1) | 1,4-Cyclohexane-dimethanol | Adipic acid | 97 | 53 | 5,300 | 21 |
| (2) | 1,4-Cyclohexane-dimethanol | Adipic acid | 104 | 75 | 8,400 | 54 |
| (3) | 1,4-butanediol-ethyleneglycol | | 85 | 43 | 3,600 | 4.6 |
| (4) | ethyleneglycol | | 73 | 37 | 4,300 | 10 |
| (5) | 1,6-hexanediol | | 66 | 31 | 3,600 | 8 |

Preparation Example LP-1

Placed into a 5,000 ml separable flask fitted with a stirring unit, a temperature sensor, a cooling pipe, and a nitrogen gas inlet was a surface active agent solution (water based medium) prepared by dissolving 60 g of an anionic surface active agent (sodium dodecylbenzenesulfonate: SDS) in 5,000 g of deionized water, and the interior temperature was raised to 80° C. under a nitrogen gas flow while stirring at 230 rpm.

Subsequently, a solution prepared by dissolving 22.8 g of a polymerization initiator potassium persulfate (KPS) in 200 g of deionized water was added to the surface active agent solution and it was kept at 80° C., a monomer mixture solution consisting of 850 g of styrene, 252 g of butyl acrylate, 98 g of methacrylic acid and 32 g of t-dodecylmercaptan was added dropwise over 1 hour. The mixture underwent polymerization by stirring for 2 hours at 80° C. Thus latex (a dispersion comprised of lower molecular weight resin particles) was obtained. The resulting latex was designated as Latex (LP-1).

The polymers composed of resin particles composing the Latex (LP-1) has peak at molecular weight of 18,000, and weight average molecular weight of the composite resin particles was 105 nm.

Preparation Example 1Bk

Added to 1600 ml of deionized water were 90 g of sodium n-dodecylsulfate which were stirred and dissolved. While stirring the resulting solution, 200 g of carbon black, "Morgal L" (produced by Cabot Corp.), were gradually added, and subsequently dispersed employing a stirring unit, "Clearmix" (produced by M Technique Ltd.) equipped with a high speed rotation rotor. Thus a colorant particle dispersion (hereinafter referred to as "Colorant Dispersion (Bk)") was prepared. The colorant particle size of said Colorant Dispersion (Bk) was determined employing an electrophoresis light scattering photometer "ELS-800" (produced by Ohtsuka Denshi Co.), resulting in a weight average particle size measurement of 101 nm.

Placed into a reaction vessel fitted with a temperature sensor, a cooling pipe, a nitrogen gas inlet unit, and a stirring unit were 3,000 g of Latex (HP-1) obtained in Preparation Example HP-1, 2,500 g of Latex (MP-1) obtained in Preparation Example MP-1, 6,000 g of Latex (LP-1) obtained in Preparation Example LP-1, 2,000 g of deionized water, and 1,800 g of Colorant Dispersion (Bk) prepared as previously described, and the resulting mixture was stirred. After adjusting the interior temperature to 30° C., 5N aqueous sodium hydroxide solution was added to the resulting solution, and the pH was adjusted to 11.0. Subsequently, an aqueous solution prepared by dissolving 526 g of magnesium chloride hexahydrate in 720 ml of deionized water was added at 30° C. over 10 minutes. After setting the resulting mixture aside for 3 minutes, it was heated so that the temperature was increased to 90° C. within 6 minutes (at a temperature increase rate of 10° C./minute). While maintaining the resulting state, the diameter of coalesced particles was measured employing a "Coulter Counter TA-II". When the volume average particle size reached 6.5 μm, the growth of particles was terminated by the addition of an aqueous solution prepared by dissolving 1,150 g of sodium chloride in 7,000 ml of deionized water, and further fusion was continually carried out at a liquid media temperature of 85° C. for 2 hours, while being heated and stirred (digestion process). Thereafter, the temperature was decreased to 30° C. at a rate of 8° C./minute. Subsequently, the pH was adjusted to 2.0, and stirring was terminated. The resulting coalesced particles were collected through filtration, and repeatedly washed with deionized water. Washed particles were then dried by 40° C. air, and thus colored particles were obtained. The colored particles obtained as previously described were designated as "Colored Particles 1Bk".

(Preparation Example 2Bk Through 10Bk and Comparative Preparation Example 1bk

In accordance with composition program shown in Table 2, colored particles containing a releasing agent were obtained in the same way as Preparation Example 1Bk, except that at least one of kind of latex, temperature of digestion process and period of digestion process was modified. Amount of the latex was maintained. The colored particles thus obtained were designated as "Colored Particles 2Bk" through "Colored Particles 10Bk" and "Comparative Colored Particles 1bk".

Preparation Comparative Preparation Example 2bk

Melted Exemplified Compound 19) by heating in an amount of 140 g was dispersed by a ultrasonic homogenizer in a surfactant solution (85° C.) containing 0.5 g of anionic surfactant SDS in 4,000 g of deionized water. The dispersion is designated as "Releasing Agent Dispersion".

Colored particles containing a releasing agent were obtained in the same way as Preparation Example 1Bk, except that 3,000 g of Latex (HP-1) obtained in Preparation Example HP-1, 6,000 g of Latex (LP-1) obtained in Preparation Example LP-1, 2,000 g of deionized water, and 1,300 g of Colorant Dispersion (Bk) were placed into a reaction vessel fitted with a temperature sensor, a cooling pipe, a nitrogen gas inlet unit, and a stirring unit, and the resulting mixture was stirred and digestion process was varied to 4 hours. The colored particles thus obtained were designated as "Comparative Colored Particles 2bk".

TABLE 2

| | Latex | | | Digestion Process | |
|---|---|---|---|---|---|
| Colored Particles | Emulsion Polymerization | Mini-emulsion Polymerization | Emulsion Polymerization | Temp. | Period (hours) |
| 1Bk | HP-1 | MP-1 | LP-1 | 85° C. | 2 |
| 2Bk | HP-1 | MP-1 | LP-1 | 85° C. | 4 |
| 3Bk | HP-1 | MP-1 | LP-1 | 85° C. | 6 |
| 4Bk | HP-1 | MP-1 | LP-1 | 85° C. | 8 |
| 5Bk | HP-1 | MP-1 | LP-1 | 80° C. | 6 |
| 6Bk | HP-1 | MP-1 | LP-1 | 80° C. | 10 |
| 7Bk | HP-2 | MP-2 | LP-1 | 85° C. | 4 |
| 8Bk | HP-3 | MP-3 | LP-1 | 85° C. | 4 |
| 9Bk | HP-4 | MP-4 | LP-1 | 85° C. | 4 |
| 10Bk | HP-1 | MP-5 | LP-1 | 85° C. | 4 |
| Comp. 1bk | HP-1 | MP-1 | LP-1 | 95° C. | 1 |
| Comp. 2bk | HP-1 | — | LP-1 | 85° C. | 4 |

Comp.: Comparative

Preparation Example 11Bk Through 23Bk and Comparative Preparation Example 3bk

In accordance with composition program shown in Table 3, colored particles containing a releasing agent were obtained in the same way as Preparation Example 1Bk, except that at least one of kind of latex, temperature of digestion process and period of digestion process was modified. Amount of the latex was maintained. The colored particles thus obtained were designated as "Colored Particles 11Bk" through "Colored Particles 23Bk" and "Comparative Colored Particles 3bk".

Preparation Comparative Preparation Example 4bk

Crystalline polyester (1) in an amount of 200 g was dispersed by a ultrasonic homogenizer in a surfactant solution (85° C.) containing 0.5 g of anionic surfactant SDS in 4,000 g of deionized water. The dispersion is designated as "Crystalline Polyester Dispersion".

Colored particles containing a releasing agent were obtained in the same way as Preparation Example 1Bk, except that 3,000 g of Latex (HP-1) obtained in Preparation Example HP-1, 6,000 g of Latex (LP-1) obtained in Preparation Example LP-1, 2,000 g of deionized water, and 1,300 g of Colorant Dispersion (Bk) were placed into a reaction vessel fitted with a temperature sensor, a cooling pipe, a nitrogen gas inlet unit, and a stirring unit, and the resulting mixture was stirred and digestion process was varied to 4 hours. The colored particles thus obtained were designated as "Comparative Colored Particles 4bk".

TABLE 3

| | Latex | | | Digestion Process | |
|---|---|---|---|---|---|
| Colored Particles | Emulsion Polymerization | Mini-emulsion Polymerization | Emulsion Polymerization | Temp. | Period (hours) |
| 11Bk | HP-1 | MP-6 | LP-1 | 85° C. | 2 |
| 12Bk | HP-1 | MP-6 | LP-1 | 85° C. | 4 |
| 13Bk | HP-1 | MP-6 | LP-1 | 85° C. | 6 |
| 14Bk | HP-1 | MP-6 | LP-1 | 85° C. | 8 |
| 15Bk | HP-1 | MP-6 | LP-1 | 80° C. | 6 |
| 16Bk | HP-1 | MP-6 | LP-1 | 80° C. | 10 |
| 17Bk | HP-2 | MP-7 | LP-1 | 85° C. | 4 |
| 18Bk | HP-3 | MP-8 | LP-1 | 85° C. | 4 |
| 19Bk | HP-4 | MP-9 | LP-1 | 85° C. | 4 |
| 20Bk | HP-1 | MP-10 | LP-1 | 85° C. | 4 |
| 21Bk | HP-1 | MP-11 | LP-1 | 85° C. | 4 |
| 22Bk | HP-1 | MP-12 | LP-1 | 85° C. | 4 |
| 23Bk | HP-1 | MP-13 | LP-1 | 85° C. | 4 |
| Comp. 3bk | HP-1 | MP-6 | LP-1 | 95° C. | 1 |
| Comp. 4bk | HP-1 | — | LP-1 | 85° C. | 4 |

Comp.: Comparative

Preparation Example 1Y

Added to 1,600 ml of deionized water were 90 g of sodium n-dodecylsulfate which were stirred and dissolved. While stirring the resulting solution, 200 g of a dye (C.I. Solvent Yellow 92), were gradually added, and subsequently dispersed employing a stirring unit, "Clearmix" (produced by M Technique Ltd.) equipped with a high speed rotation rotor. Thus a colorant particle dispersion (hereinafter referred to as "Colorant Dispersion (Y)") was prepared. The colorant particle size of said Colorant Dispersion (Y) was determined employing an electrophoresis light scattering photometer "ELS-800" (produced by Ohtsuka Denshi Co.), resulting in a weight average particle size measurement of 98 nm.

Placed into a reaction vessel fitted with a temperature sensor, a cooling pipe, a nitrogen gas inlet unit, and a stirring unit were 3,000 g of Latex (HP-1) obtained in Preparation Example HP-1, 2,500 g of Latex (MP-1) obtained in Preparation Example MP-1, 6,000 g of Latex (LP-1) obtained in Preparation Example LP-1, 2,000 g of deionized water, and 1,800 g of Colorant Dispersion (Y) prepared as previously described, and the resulting mixture was stirred. After adjusting the interior temperature to 30° C., 5N aqueous sodium hydroxide solution was added to the resulting solution, and the pH was adjusted to 11.0. Subsequently, an aqueous solution prepared by dissolving 526 g of magnesium chloride hexahydrate in 720 ml of deionized water was added at 30° C. over 10 minutes. After setting the resulting mixture aside for 3 minutes, it was heated so that the temperature was increased to 90° C. within 6 minutes (at a temperature increase rate of 10° C./minute) . While maintaining the resulting state, the diameter of coalesced particles was measured employing a "Coulter Counter TA-II". When the volume average particle size reached 6.5 $\mu$m, the growth of particles was terminated by the addition of an aqueous solution prepared by dissolving 1,150 g of sodium chloride in 7,000 ml of deionized water, and further fusion was continually carried out at a liquid media temperature of 85° C. for 4 hours, while being heated and stirred (digestion process). Thereafter, the temperature was decreased to 30° C. at a rate of 8° C./minute. Subsequently, the pH was adjusted to 2.0, and stirring was terminated. The resulting coalesced particles were collected through filtration, and repeatedly washed with deionized water. Washed particles were then dried by 40° C. air, and thus colored particles were obtained. The colored particles obtained as previously described were designated as "Colored Particles 1Y".

Preparation Example 2Y Through 4Y and Comparative Preparation Example 1y

In accordance with composition program shown in Table 4, colored particles containing a releasing agent were obtained in the same way as Preparation Example 1Y, except that at least one of kind of latex, temperature of digestion process and period of digestion process was modified. Amount of the latex was maintained. The colored particles thus obtained were designated as "Colored Particles 2Y" through "Colored Particles 4Y" and "Comparative Colored Particles 1y".

Preparation Comparative Preparation Example 2y

Melted Exemplified Compound 19) by heating in an amount of 140 g was dispersed by a ultrasonic homogenizer in a surfactant solution (85° C.) containing 0.5 g of anionic surfactant SDS in 400 g of deionized water. The dispersion is designated as "Releasing Agent Dispersion".

Colored particles containing a releasing agent were obtained in the same way as Preparation Example 1Y, except that 3,000 g of Latex (HP-1) obtained in Preparation Example HP-1, 6,000 g of Latex (LP-1) obtained in Preparation Example LP-1, 2,000 g of deionized water and 1,300 g of Colorant Dispersion (Y) were placed into a reaction vessel fitted with a temperature sensor, a cooling pipe, a nitrogen gas inlet unit, and a stirring unit, and the resulting mixture was stirred. The colored particles thus obtained were designated as "Comparative Colored Particles 2y".

Preparation Example 5Y Through 12Y and Comparative Preparation Example 3y

In accordance with composition program shown in Tables 5 and 6, colored particles containing a releasing agent were obtained in the same way as Preparation Example 1Y, except that at least one of kind of latex, temperature of digestion process and period of digestion process was modified. Amount of the latex was maintained. The colored particles thus obtained were designated as "Colored Particles 5Y" through "Colored Particles 12Y" and "Comparative Colored Particles 3y".

Preparation Comparative Preparation Example 4y

Crystalline polyester (1) in an amount of 200 g was dispersed by a ultrasonic homogenizer in a surfactant solution (85° C.) containing 0.5 g of anionic surfactant SDS in 4,000 g of deionized water. The dispersion is designated as "Crystalline Polyester Dispersion".

Colored particles containing a releasing agent were obtained in the same way as Preparation Example 1Y, except that 3,000 g of Latex (HP-1) obtained in Preparation Example HP-1, 6,000 g of Latex (LP-1) obtained in Preparation Example LP-1, 2,000 g of deionized water, and 1,300 g of Colorant Dispersion (Y) were placed into a reaction vessel fitted with a temperature sensor, a cooling pipe, a nitrogen gas inlet unit, and a stirring unit, and the resulting mixture was stirred. The colored particles thus obtained were designated as "Comparative Colored Particles 4y".

Preparation Example 1M

Added to 1,600 ml of deionized water were 90 g of sodium n-dodecylsulfate which were stirred and dissolved. While stirring the resulting solution, 200 g of a dye (C.I. Pigment Red 122), were gradually added, and subsequently dispersed employing a stirring unit, "Clearmix" (produced by M Technique Ltd.) equipped with a high speed rotation rotor. Thus a colorant particle dispersion (hereinafter referred to as "Colorant Dispersion (M)") was prepared. The colorant particle size of said Colorant Dispersion (M) was determined employing an electrophoresis light scattering photometer "ELS-800" (produced by Ohtsuka Denshi Co.), resulting in a weight average particle size measurement of 115 nm.

Placed into a reaction vessel fitted with a temperature sensor, a cooling pipe, a nitrogen gas inlet unit, and a stirring unit were 3,000 g of Latex (HP-1) obtained in Preparation Example HP-1, 2,500 g of Latex (MP-1) obtained in Preparation Example MP-1, 6,000 g of Latex (LP-1) obtained in Preparation Example LP-1, 2,000 g of deionized water, and 1,800 g of Colorant Dispersion (M) prepared as previously described, and the resulting mixture was stirred. After adjusting the interior temperature to 30° C., 5N aqueous sodium hydroxide solution was added to the resulting solution, and the pH was adjusted to 11.0. Subsequently, an aqueous solution prepared by dissolving 526 g of magnesium chloride hexahydrate in 720 ml of deionized water was added at 30° C. over 10 minutes. After setting the resulting mixture aside for 3 minutes, it was heated so that the temperature was increased to 90° C. within 6 minutes (at a temperature increase rate of 10° C./minute). While maintaining the resulting state, the diameter of coalesced particles was measured employing a "Coulter Counter TA-II". When the volume average particle size reached 6.5 $\mu$m, the growth of particles was terminated by the addition of an aqueous solution prepared by dissolving 1,150 g of sodium chloride in 7,000 ml of deionized water, and further fusion was continually carried out at a liquid media temperature of 85° C. for 4 hours, while being heated and stirred (digestion process). Thereafter, the temperature was decreased to 30° C. at a rate of 8° C./minute. Subsequently, the pH was adjusted to 2.0, and stirring was terminated. The resulting coalesced particles were collected through filtration, and repeatedly washed with deionized water. Washed particles were then dried by 40° C. air, and thus colored particles were obtained. The colored particles obtained as previously described were designated as "Colored Particles 1M".

Preparation Example 2M Through 4M and Comparative Preparation Example 1m

In accordance with composition program shown in Table 4, colored particles containing a releasing agent were obtained in the same way as Preparation Example 1M, except that at least one of kind of latex, temperature of digestion process and period of digestion process was modified. Amount of the latex was maintained. The colored particles thus obtained were designated as "Colored Particles 2M" through "Colored Particles 4M" and "Comparative Colored Particles 1m".

Preparation Comparative Preparation Example 2m

Melted Exemplified Compound 19) by heating in an amount of 140 g was dispersed by a ultrasonic homogenizer in a surfactant solution (85° C.) containing 0.5 g of anionic surfactant SDS in 4,000 g of deionized water. The dispersion is designated as "Releasing Agent Dispersion".

Colored particles containing a releasing agent were obtained in the same way as Preparation Example 1M, except that 3,000 g of Latex (HP-1) obtained in Preparation Example HP-1, 6,000 g of Latex (LP-1) obtained in Preparation Example LP-1, 2,000 g of deionized water and 1,300 g of Colorant Dispersion (M) were placed into a reaction vessel fitted with a temperature sensor, a cooling pipe, a nitrogen gas inlet unit, and a stirring unit, and the resulting mixture was stirred. The colored particles thus obtained were designated as "Comparative Colored Particles 2m".

Preparation Example 5Y Through 12Y and Comparative Preparation Example 3y

In accordance with composition program shown in Tables 5 and 6, colored particles containing a releasing agent were obtained in the same way as Preparation Example 1M, except that at least one of kind of latex, temperature of digestion process and period of digestion process was modified. Amount of the latex was maintained. The colored particles thus obtained were designated as "Colored Particles 5M" through "Colored Particles 12M" and "Comparative Colored Particles 3m".

Preparation Comparative Preparation Example 4m

Crystalline polyester (1) in an amount of 200 g was dispersed by a ultrasonic homogenizer in a surfactant solution (85° C.) containing 0.5 g of anionic surfactant SDS in 4,000 g of deionized water. The dispersion is designated as "Crystalline Polyester Dispersion".

Colored particles containing a releasing agent were obtained in the same way as Preparation Example 1M, except that 3,000 g of Latex (HP-1) obtained in Preparation Example HP-1, 6,000 g of Latex (LP-1) obtained in Preparation Example LP-1, 2,000 g of deionized water and 1,300 g of Colorant Dispersion (M) were placed into a reaction vessel fitted with a temperature sensor, a cooling pipe, a nitrogen gas inlet unit, and a stirring unit, and the resulting mixture was stirred. The colored particles thus obtained were designated as "Comparative Colored Particles 4m".

Preparation Example 1C

Added to 1,600 ml of deionized water were 90 g of sodium n-dodecylsulfate which were stirred and dissolved. While stirring the resulting solution, 200 g of a dye (C.I. Pigment Blue 15:3), were gradually added, and subsequently dispersed employing a stirring unit, "Clearmix" (produced by M Technique Ltd.) equipped with a high speed rotation rotor. Thus a colorant particle dispersion (hereinafter referred to as "Colorant Dispersion (C)") was prepared. The colorant particle size of said Colorant Dispersion (C) was determined employing an electrophoresis light scattering photometer "ELS-800" (produced by Ohtsuka Denshi Co.), resulting in a weight average particle size measurement of 105 nm.

Placed into a reaction vessel fitted with a temperature sensor, a cooling pipe, a nitrogen gas inlet unit, and a stirring unit were 3,000 g of Latex (HP-1) obtained in Preparation Example HP-1, 2,500 g of Latex (MP-1) obtained in Preparation Example MP-1, 6,000 g of Latex (LP-1) obtained in Preparation Example LP-1, 2,000 g of deionized water, and 1,300 g of Colorant Dispersion (C) prepared as previously described, and the resulting mixture was stirred. After adjusting the interior temperature to 30° C., 5N aqueous sodium hydroxide solution was added to the resulting solution, and the pH was adjusted to 11.0. Subsequently, an aqueous solution prepared by dissolving 526 g of magnesium chloride hexahydrate in 720 ml of deionized water was added at 30° C. over 10 minutes. After setting the resulting mixture aside for 3 minutes, it was heated so that the temperature was increased to 90° C. within 6 minutes (at a temperature increase rate of 10° C./minute). While maintaining the resulting state, the diameter of coalesced particles was measured employing a "Coulter Counter TA-II". When the volume average particle size reached 6.5 $\mu$m, the growth of particles was terminated by the addition of an aqueous solution prepared by dissolving 1,150 g of sodium chloride in 7,000 ml of deionized water, and further fusion was continually carried out at a liquid media temperature of 85° C. for 4 hours, while being heated and stirred (digestion process). Thereafter, the temperature was decreased to 30° C. at a rate of 8° C./minute. Subsequently, the pH was adjusted to 2.0, and stirring was terminated. The resulting coalesced particles were collected through filtration, and repeatedly washed with deionized water. Washed particles were then dried by 40° C. air, and thus colored particles were obtained. The colored particles obtained as previously described were designated as "Colored Particles 1C".

Preparation Example 2C through 4C and Comparative Preparation Example 1c

In accordance with composition program shown in Table 4, colored particles containing a releasing agent were obtained in the same way as Preparation Example 1C, except that at least one of kind of latex, temperature of digestion process and period of digestion process was modified. Amount of the latex was maintained. The colored particles thus obtained were designated as "Colored Particles 2C" through "Colored Particles 4C" and "Comparative Colored Particles 1c".

Preparation Comparative Preparation Example 2c

Melted Exemplified Compound 19) by heating in an amount of 140 g was dispersed by a ultrasonic homogenizer in a surfactant solution (85° C.) containing 0.5 g of anionic surfactant SDS in 4,000 g of deionized water. The dispersion is designated as "Releasing Agent Dispersion".

Colored particles containing a releasing agent were obtained in the same way as Preparation Example 1M, except that 3,000 g of Latex (HP-1) obtained in Preparation Example HP-1, 6,000 g of Latex (LP-1) obtained in Preparation Example LP-1, 2,000 g of deionized water and 1,300 g of Colorant Dispersion (M) were placed into a reaction vessel fitted with a temperature sensor, a cooling pipe, a nitrogen gas inlet unit, and a stirring unit, and the resulting mixture was stirred. The colored particles thus obtained were designated as "Comparative Colored Particles 2m".

Preparation Example 5C Through 12C and Comparative Preparation Example 3c

In accordance with composition program shown in Tables 5 and 6, colored particles containing a releasing agent were obtained in the same way as Preparation Example 1C, except that at least one of kind of latex, temperature of digestion process and period of digestion process was modified. Amount of the latex was maintained. The colored particles thus obtained were designated as "Colored Particles 5C" through "Colored Particles 12C" and "Comparative Colored Particles 3c".

Preparation Comparative Preparation Example 4c

Crystalline polyester (1) in an amount of 200 g was dispersed by a ultrasonic homogenizer in a surfactant solution (85° C.) containing 0.5 g of anionic surfactant SDS in 4,000 g of deionized water. The dispersion is designated as "Crystalline Polyester Dispersion".

Colored particles containing a releasing agent were obtained in the same way as Preparation Example 1C, except that 3,000 g of Latex (HP-1) obtained in Preparation Example HP-1, 6,000 g of Latex (LP-1) obtained in Preparation Example LP-1, 2,000 g of deionized water and 1,300 g of Colorant Dispersion (C) were placed into a reaction vessel fitted with a temperature sensor, a cooling pipe, a nitrogen gas inlet unit, and a stirring unit, and the resulting mixture was stirred. The colored particles thus obtained were designated as "Comparative Colored Particles 4c".

TABLE 4

| Colored Particles | Latex | | | Digestion Process | |
|---|---|---|---|---|---|
| | Emulsion Polymerization | Mini-emulsion Polymerization | Emulsion Polymerization | Temp. | Period (hours) |
| 1Y | HP-1 | MP-1 | LP-1 | 85° C. | 4 |
| 1M | HP-1 | MP-1 | LP-1 | 85° C. | 4 |
| 1C | HP-1 | MP-1 | LP-1 | 85° C. | 4 |
| 2Y | HP-2 | MP-2 | LP-1 | 85° C. | 4 |
| 2M | HP-2 | MP-2 | LP-1 | 85° C. | 4 |
| 2C | HP-2 | MP-2 | LP-1 | 85° C. | 4 |
| 3Y | HP-3 | MP-3 | LP-1 | 85° C. | 4 |
| 3M | HP-3 | MP-3 | LP-1 | 85° C. | 4 |
| 3C | HP-3 | MP-3 | LP-1 | 85° C. | 4 |
| 4Y | HP-4 | MP-4 | LP-1 | 85° C. | 4 |
| 4M | HP-4 | MP-4 | LP-1 | 85° C. | 4 |
| 4C | HP-4 | MP-4 | LP-1 | 85° C. | 4 |
| Comp. 1y | HP-1 | MP-5 | LP-1 | 95° C. | 1 |
| Comp. 1m | HP-1 | MP-5 | LP-1 | 95° C. | 1 |
| Comp. 1c | HP-1 | MP-5 | LP-1 | 95° C. | 1 |
| Comp. 2y | HP-1 | — | LP-1 | 85° C. | 4 |
| Comp. 2m | HP-1 | — | LP-1 | 85° C. | 4 |
| Comp. 2c | HP-1 | — | LP-1 | 85° C. | 4 |

Comp.: Comparative

TABLE 5

| Colored Particles | Latex | | | Digestion Process | |
|---|---|---|---|---|---|
| | Emulsion Polymerization | Mini-emulsion Polymerization | Emulsion Polymerization | Temp. | Period (hours) |
| 5Y | HP-1 | MP-6 | LP-1 | 85° C. | 4 |
| 5M | HP-1 | MP-6 | LP-1 | 85° C. | 4 |
| 5C | HP-1 | MP-6 | LP-1 | 85° C. | 4 |
| 6Y | HP-2 | MP-7 | LP-1 | 85° C. | 4 |
| 6M | HP-2 | MP-7 | LP-1 | 85° C. | 4 |
| 6C | HP-2 | MP-7 | LP-1 | 85° C. | 4 |
| 7Y | HP-3 | MP-8 | LP-1 | 85° C. | 4 |
| 7M | HP-3 | MP-8 | LP-1 | 85° C. | 4 |
| 7C | HP-3 | MP-8 | LP-1 | 85° C. | 4 |
| 8Y | HP-4 | MP-9 | LP-1 | 85° C. | 4 |
| 8M | HP-4 | MP-9 | LP-1 | 85° C. | 4 |
| 8C | HP-4 | MP-9 | LP-1 | 85° C. | 4 |
| 9Y | HP-1 | MP-10 | LP-1 | 85° C. | 4 |
| 9M | HP-1 | MP-10 | LP-1 | 85° C. | 4 |
| 9C | HP-1 | MP-10 | LP-1 | 85° C. | 4 |

TABLE 6

| Colored Particles | Latex | | | Digestion Process | |
|---|---|---|---|---|---|
| | Emulsion Polymerization | Mini-emulsion Polymerization | Emulsion Polymerization | Temp. | Period (hours) |
| 10Y | HP-2 | MP-11 | LP-1 | 85° C. | 4 |
| 10M | HP-2 | MP-11 | LP-1 | 85° C. | 4 |
| 10C | HP-2 | MP-11 | LP-1 | 85° C. | 4 |
| 11Y | HP-3 | MP-12 | LP-1 | 85° C. | 4 |
| 11M | HP-3 | MP-12 | LP-1 | 85° C. | 4 |
| 11C | HP-3 | MP-12 | LP-1 | 85° C. | 4 |
| 12Y | HP-4 | MP-13 | LP-1 | 85° C. | 4 |
| 12M | HP-4 | MP-13 | LP-1 | 85° C. | 4 |
| 12C | HP-4 | MP-13 | LP-1 | 85° C. | 4 |
| Comp. 3y | HP-1 | MP-6 | LP-1 | 95° C. | 1 |
| Comp. 3m | HP-1 | MP-6 | LP-1 | 95° C. | 1 |
| Comp. 3c | HP-1 | MP-6 | LP-1 | 95° C. | 1 |

TABLE 6-continued

| Colored Particles | Latex | | | Digestion Process | |
|---|---|---|---|---|---|
| | Emulsion Polymerization | Mini-emulsion Polymerization | Emulsion Polymerization | Temp. | Period (hours) |
| Comp. 4y | HP-1 | — | LP-1 | 85° C. | 4 |
| Comp. 4m | HP-1 | — | LP-1 | 85° C. | 4 |
| Comp. 4c | HP-1 | — | LP-1 | 85° C. | 4 |

Comp.: Comparative

Shape characteristics and particle distribution characteristics are shown in Tables 7 to 11.

TABLE 7

| Colored Particles Containing Releasing Agent | Average Shape Coefficient | Variation Coefficient of Shape Coefficient (%) | Number Average Particle Size (μm) | Number Variation Coefficient of Number Particle Size Distribution | Particles Having Shape Coefficient of 1.0–1.6 (%) | Particles Having Shape Coefficient of 1.2–1.6 (%) | Particles Having No Corner (%) | M (m1 + m2) (%) |
|---|---|---|---|---|---|---|---|---|
| 1Bk | 1.57 | 15 | 6.3 | 25 | 93 | 85 | 84 | 72 |
| 2Bk | 1.54 | 14 | 6.4 | 23 | 92 | 82 | 86 | 74 |
| 3Bk | 1.42 | 14 | 6.8 | 24 | 88 | 79 | 90 | 72 |
| 4Bk | 1.30 | 13 | 7.3 | 20 | 75 | 65 | 92 | 78 |
| 5Bk | 1.54 | 13 | 7.0 | 21 | 80 | 85 | 88 | 74 |
| 6Bk | 1.34 | 12 | 6.8 | 22 | 76 | 70 | 91 | 71 |
| 7Bk | 1.49 | 13 | 6.7 | 21 | 81 | 75 | 88 | 74 |
| 8Bk | 1.43 | 14 | 6.7 | 21 | 85 | 73 | 86 | 80 |
| 9Bk | 1.39 | 12 | 6.8 | 20 | 91 | 80 | 89 | 79 |
| 10Bk | 1.43 | 13 | 6.5 | 22 | 83 | 75 | 87 | 77 |
| Comp. 1bk | 1.61 | 19 | 6.2 | 29 | 62 | 61 | 41 | 70 |
| Comp. 2bk | 1.56 | 19 | 6.9 | 29 | 71 | 68 | 81 | 74 |

Comp.: Comparative

TABLE 8

| Colored Particles | Average Shape Coefficient | Variation Coefficient of Shape Coefficient (%) | Number Average Particle Size (μm) | Number Variation Coefficient of Number Particle Size Distribution | Particles Having Shape Coefficient of 1.0–1.6 (%) | Particles Having Shape Coefficient of 1.2–1.6 (%) | Particles Having No Corner (%) | M (m1 + m2) (%) |
|---|---|---|---|---|---|---|---|---|
| 11Bk | 1.58 | 14 | 6.3 | 24 | 91 | 85 | 85 | 72 |
| 12Bk | 1.55 | 13 | 6.4 | 23 | 85 | 83 | 87 | 74 |
| 13Bk | 1.42 | 15 | 6.8 | 24 | 83 | 80 | 91 | 72 |
| 14Bk | 1.29 | 13 | 7.4 | 21 | 70 | 66 | 93 | 78 |
| 15Bk | 1.50 | 13 | 7.4 | 20 | 88 | 84 | 89 | 74 |
| 16Bk | 1.30 | 11 | 6.8 | 21 | 80 | 71 | 92 | 71 |
| 17Bk | 1.51 | 14 | 6.8 | 20 | 79 | 75 | 89 | 74 |
| 18Bk | 1.44 | 15 | 6.7 | 22 | 79 | 73 | 85 | 80 |
| 19Bk | 1.40 | 13 | 6.8 | 21 | 81 | 80 | 88 | 79 |
| 20Bk | 1.45 | 13 | 6.6 | 22 | 78 | 75 | 86 | 76 |
| 21Bk | 1.44 | 14 | 6.5 | 23 | 79 | 76 | 86 | 78 |
| 22Bk | 1.45 | 14 | 6.6 | 21 | 81 | 75 | 88 | 79 |
| 23Bk | 1.46 | 13 | 6.5 | 22 | 88 | 76 | 87 | 78 |
| Comp. 3bk | 1.63 | 20 | 6.3 | 31 | 61 | 60 | 40 | 70 |
| Comp. 4bk | 1.58 | 14 | 6.3 | 24 | 90 | 86 | 85 | 72 |

Comp.: Comparative

TABLE 9

| Colored Particles | Average Shape Coefficient | Variation Coefficient of Shape Coefficient (%) | Number Average Particle Size (μm) | Number Variation Coefficient of Number Particle Size Distribution | Particles Having Shape Coefficient of 1.0–1.6 (%) | Particles Having Shape Coefficient of 1.2–1.6 (%) | Particles Having No Corner (%) | M (m1 + m2) (%) |
|---|---|---|---|---|---|---|---|---|
| 1Y | 1.54 | 14 | 6.6 | 23 | 83 | 82 | 86 | 75 |
| 1M | 1.53 | 14 | 6.4 | 24 | 83 | 81 | 86 | 77 |
| 1C | 1.54 | 13 | 6.5 | 23 | 85 | 82 | 88 | 74 |
| 2Y | 1.51 | 15 | 6.4 | 22 | 85 | 82 | 84 | 74 |
| 2M | 1.54 | 15 | 6.3 | 21 | 88 | 86 | 83 | 77 |
| 2C | 1.53 | 14 | 6.4 | 23 | 88 | 82 | 82 | 76 |
| 3Y | 1.54 | 13 | 6.5 | 24 | 88 | 82 | 85 | 77 |
| 3M | 1.54 | 14 | 6.6 | 21 | 89 | 83 | 82 | 74 |
| 3C | 1.56 | 13 | 6.4 | 22 | 88 | 82 | 86 | 77 |
| 4Y | 1.54 | 14 | 6.4 | 23 | 91 | 87 | 84 | 76 |
| 4M | 1.52 | 13 | 6.4 | 23 | 89 | 84 | 86 | 74 |
| 4C | 1.53 | 14 | 6.5 | 22 | 89 | 84 | 87 | 77 |
| Comp. 1y | 1.62 | 18 | 7.1 | 29 | 64 | 62 | 86 | 77 |
| Comp. 1m | 1.63 | 17 | 7.3 | 28 | 63 | 62 | 88 | 75 |
| Comp. 1c | 1.61 | 18 | 7.4 | 29 | 64 | 63 | 87 | 74 |
| Comp. 2y | 1.68 | 18 | 6.8 | 29 | 71 | 68 | 86 | 74 |
| Comp. 2m | 1.63 | 18 | 6.3 | 29 | 72 | 69 | 88 | 74 |
| Comp. 2c | 1.69 | 19 | 6.9 | 28 | 71 | 68 | 86 | 74 |

Comp.: Comparative

TABLE 10

| Colored Particles | Average Shape Coefficient | Variation Coefficient of Shape Coefficient (%) | Number Average Particle Size (μm) | Number Variation Coefficient of Number Particle Size Distribution | Particles Having Shape Coefficient of 1.0–1.6 (%) | Particles Having Shape Coefficient of 1.2–1.6 (%) | Particles Having No Corner (%) | M (m1 + m2) (%) |
|---|---|---|---|---|---|---|---|---|
| 5Y | 1.55 | 14 | 6.6 | 22 | 88 | 82 | 86 | 75 |
| 5M | 1.55 | 15 | 6.6 | 22 | 88 | 82 | 85 | 77 |
| 5C | 1.53 | 13 | 6.5 | 23 | 88 | 83 | 88 | 75 |
| 6Y | 1.53 | 14 | 6.4 | 21 | 87 | 82 | 84 | 74 |
| 6M | 1.55 | 15 | 6.4 | 21 | 91 | 86 | 83 | 76 |
| 6C | 1.56 | 14 | 6.5 | 22 | 89 | 82 | 82 | 78 |
| 7Y | 1.55 | 15 | 6.6 | 23 | 86 | 83 | 85 | 78 |
| 7M | 1.54 | 14 | 6.6 | 22 | 88 | 85 | 82 | 75 |
| 7C | 1.55 | 15 | 6.4 | 22 | 88 | 83 | 86 | 78 |
| 8Y | 1.54 | 14 | 6.4 | 23 | 90 | 87 | 84 | 79 |
| 8M | 1.52 | 15 | 6.4 | 22 | 88 | 84 | 86 | 76 |
| 8C | 1.55 | 14 | 6.5 | 21 | 92 | 86 | 88 | 78 |
| 9Y | 1.54 | 15 | 6.7 | 24 | 83 | 80 | 85 | 76 |
| 9M | 1.53 | 14 | 6.4 | 24 | 88 | 83 | 87 | 77 |
| 9C | 1.54 | 13 | 6.5 | 23 | 86 | 80 | 89 | 74 |

TABLE 11

| Colored Particles | Average Shape Coefficient | Variation Coefficient of Shape Coefficient (%) | Number Average Particle Size (μm) | Number Variation Coefficient of Number Particle Size Distribution | Particles Having Shape Coefficient of 1.0–1.6 (%) | Particles Having Shape Coefficient of 1.2–1.6 (%) | Particles Having No Corner (%) | M (m1 + m2) (%) |
|---|---|---|---|---|---|---|---|---|
| 10Y | 1.51 | 15 | 6.4 | 22 | 83 | 82 | 84 | 75 |
| 10M | 1.53 | 13 | 6.3 | 21 | 89 | 86 | 83 | 76 |
| 10C | 1.53 | 15 | 6.4 | 23 | 88 | 82 | 82 | 76 |
| 11Y | 1.54 | 13 | 6.5 | 24 | 84 | 81 | 85 | 77 |
| 11M | 1.54 | 14 | 6.6 | 21 | 85 | 82 | 82 | 75 |
| 11C | 1.55 | 13 | 6.6 | 23 | 86 | 82 | 86 | 78 |
| 12Y | 1.54 | 14 | 6.4 | 24 | 91 | 88 | 84 | 76 |
| 12M | 1.52 | 13 | 6.4 | 23 | 88 | 85 | 86 | 74 |
| 12C | 1.56 | 14 | 6.5 | 23 | 87 | 84 | 87 | 77 |
| Comp. 3y | 1.66 | 19 | 7.3 | 31 | 62 | 61 | 88 | 77 |

TABLE 11-continued

| Colored Particles | Average Shape Coefficient | Variation Coefficient of Shape Coefficient (%) | Number Average Particle Size (μm) | Number Variation Coefficient of Number Particle Size Distribution | Particles Having Shape Coefficient of 1.0–1.6 (%) | Particles Having Shape Coefficient of 1.2–1.6 (%) | Particles Having No Corner (%) | M (m1 + m2) (%) |
|---|---|---|---|---|---|---|---|---|
| Comp. 3m | 1.62 | 18 | 7.5 | 32 | 61 | 60 | 89 | 75 |
| Comp. 3c | 1.65 | 19 | 7.5 | 31 | 63 | 62 | 83 | 75 |
| Comp. 4y | 1.51 | 15 | 6.4 | 22 | 83 | 82 | 84 | 75 |
| Comp. 4m | 1.53 | 13 | 6.3 | 21 | 89 | 84 | 85 | 76 |
| Comp. 4c | 1.53 | 15 | 6.4 | 23 | 89 | 83 | 85 | 76 |

Comp.: Comparative

Hydrophobic silica (having a number average primary particle size of 10 nm, a degree of hydrophobicity of 63) was added to each of said colored particles so as to result in ratio of 1.0 percent by weight and hydrophobic titanium (having a number average primary particle size of 25 nm, a degree of hydrophobicity of 60) was added to each of said colored particles so as to result in ratio of 1.2 percent by weight, and they were mixed by Henschel Mixer. No differences were found between each of colored particles and each of the resulting toners with respect to the shape, the particle size, and the like.

Each of colored particles mixed with hydrophobic silica and hydrophobic titanium as above was blended with a silicone coated ferrite carrier having a volume average particle size of 60 μm so as to result in toner concentration of 6 percent by weight. Thus developers were prepared. The resulting developers were designated as Developers 1Bk through 23Bk, Comparative Developers 1bk through 4bk, Developers 1Y through 12Y, Comparative Developers 1y through 4y, Developers 1M through 12M, Comparative Developers 1m through 4m, Developers 1C through 12C and Comparative Developers 1c through 4c, corresponding to Colored Particles 1Bk through 23Bk, Comparative Colored Particles 1bk through 4bk, Colored Particles 1Y through 12Y, Comparative Colored Particles 1y through 4y, Colored Particles 1M through 12M, Comparative Colored Particles 1m through 4m, Colored Particles 1C through 12C and Comparative Colored Particles 1c through 4c, respectively.

Examples 1 through 10 and Comparative Examples 1 and 2

Actual copying test was conducted for each of the developers obtained above employing an intermediate transfer type color copying machine Limos 910 manufactured by MINOLTA CO., LTD, and evaluation was carried out on generation of stain on the copy image, adhesion of foreign material to a photoreceptor and fine line reproduction. The result is summarized in Table 12.

Blade type cleaning unit was employed in the copying machine for the test.

Pressure contact system fixing units as shown in FIG. 2 was employed in the copying machine for the test. The configuration of the practical fixing unit is detailed below.

A heating roller (an upper roller) was prepared by covering the surface of an aluminum alloy cylinder (having an interior diameter of 30 mm, a wall thickness of 1.0 mm, and a total length of 310 mm), having a heater at the central section, with sponge-like silicone rubber (having an Asker C hardness of 30 degrees and a thickness of 8 mm). On the other hand, a pressure roller (a lower roller) was prepared by covering the surface of iron cylinder (having an interior diameter of 40 mm and a wall thickness of 2.0 mm) with a sponge-like silicone rubber (having an Asker hardness of 30 degrees and a thickness of 2.0 mm). Said heating roller was brought into contact with said pressure roller under an application of total load of 150 N to form a nip having a width of 5.8 mm. Employing said fixing unit, a linear speed for printing was set at 180 mm/second. Surface of the heating roller was covered with a tube made of tetrafluoroethylene-perfluoroalkyl vinylether copolymer (PFA) having thickness of 50 μm.

Further, employed as a cleaning mechanism was a supply method of a web system impregnated with polydiphenylsilicone (having a viscosity of 10 Pa·s at 20° C.). Fixing temperature was controlled by the surface temperature of said heating roller. Setting temperature was 175° C. Further, the coating amount of said silicone oil was adjusted to 0.1 mg/A4 sized sheet.

<Evaluation>

(1) Stain on the Copy Image

A full-color image (having a pixel ratio of 15 percent for each yellow, magenta, cyan and black image) was continually printed onto 1,000 sheets then electric power was shut off for 10 hours to rest the machine, (this operation was designated as 1 cycle) under the high temperature and normal humidity (33° C. and 50% RH). Totally 50-cylce operation (50,000 sheets copying) was performed.

During the operation, the number of sheets on which the first staining was observed was recorded.

(2) Adhesion of Foreign Material to the Photoreceptor

Photoreceptor was visually observed in each rest time during the test, and the number of sheets at which the adhesion of foreign material on the photoreceptor was observed was recorded.

(3) Fine Line Reproduction

Fine line chart was copied at the initial stage and after 50,000 copying, and number of fine lines which can be distinguished per 1 mm was measured. The fine lines which can be distinguished means that the lines can be observed as straight line without breaking by visually view through 5 times magnifier

TABLE 12

| Example | Developer Bk | Developer Y | Developer M | Developer C | Stain | Adhesion to Photo-receptor | Fine Line Reproduction* Initial | Fine Line Reproduction* After 50,000 Copies |
|---|---|---|---|---|---|---|---|---|
| 1 | 1Bk | 1Y | 1M | 1C | N. F.** | N. F. | 6 | 6 |
| 2 | 2Bk | 1Y | 1M | 1C | N. F. | N. F. | 6 | 6 |
| 3 | 3Bk | 1Y | 1M | 1C | N. F. | N. F. | 6 | 6 |
| 4 | 4Bk | 1Y | 1M | 1C | N. F. | N. F. | 6 | 6 |
| 5 | 5Bk | 1Y | 1M | 1C | N. F. | N. F. | 6 | 6 |
| 6 | 6Bk | 1Y | 1M | 1C | N. F. | N. F. | 6 | 6 |
| 7 | 7Bk | 2Y | 2M | 2C | N. F. | N. F. | 6 | 6 |
| 8 | 8Bk | 3Y | 3M | 3C | N. F. | N. F. | 6 | 6 |
| 9 | 9Bk | 4Y | 4M | 4C | N. F. | N. F. | 6 | 6 |
| 10 | 10Bk | 1Y | 1M | 1C | N. F. | N. F. | 6 | 6 |
| Comp. 1 | Comp. 1bk | Comp. 1y | Comp. 1m | Comp. 1c | 35,000 | 20,000 | 5 | 4.5 |
| Comp. 2 | Comp. 2bk | Comp. 2y | Comp. 2m | Comp. 2c | 15,000 | 10,000 | 6 | 4 |

*Lines/mm
**Not Found
Comp.: Comparative

Examples 11 through 23 and Comparative Examples 3 and 4

Actual copying test was conducted for each of the developers obtained above employing an intermediate transfer type color copying machine Limos 910 manufactured by MINOLTA CO., LTD, and evaluation was carried out on generation of stain on the copy image, adhesion of foreign material to a photoreceptor, fine line reproduction and fixing characteristics. The result is summarized in Table 13.

Blade type cleaning unit was employed in the copying machine for the test.

Pressure contact system fixing units as shown in FIG. 2 was employed in the copying machine for the test. The configuration of the practical fixing unit is detailed below.

A heating roller (an upper roller) was prepared by covering the surface of an aluminum alloy cylinder (having an interior diameter of 30 mm, a wall thickness of 1.0 mm, and a total length of 310 mm), having a heater at the central section, with sponge-like silicone rubber (having an Asker C hardness of 30 degrees and a thickness of 8 mm). On the other hand, a pressure roller (a lower roller) was prepared by covering the surface of iron cylinder (having an interior diameter of 40 mm and a wall thickness of 2.0 mm) with a sponge-like silicone rubber (having an Asker hardness of 30 degrees and a thickness of 2.0 mm). Said heating roller was brought into contact with said pressure roller under an application of total load of 150 N to form a nip having a width of 5.8 mm. Employing said fixing unit, a linear speed for printing was set at 180 mm/second. Surface of the heating roller was covered with a tube made of tetrafluoroethylene-perfluoroalkyl vinylether copolymer (PFA) having thickness of 50 $\mu$m.

Further, employed as a cleaning mechanism was a supply method of a web system impregnated with polydiphenylsilicone (having a viscosity of 10 Pa·s at 20° C.). Fixing temperature was controlled by the surface temperature of said heating roller. Setting temperature was 170° C. Further, the coating amount of said silicone oil was adjusted to 0.1 mg/A4 sized sheet.

<Evaluation>

Evaluation method of stain on the copy image, adhesion of foreign material to the photoreceptor, fine line reproduction is the same as previous Examples and the fixing characteristics are evaluated as follows.

<Fixing Characteristics>

Halftone images (having a relative reflection density of 1.0 when the density of a paper sheet is 0), in which each of yellow, magenta, cyan and black was printed employing a single color, were printed and fixing efficiency (ratio) was determined.

The fixing ratio was obtained as follows. A fixed image was rubbed employing 1 kg weight wrapped with bleached cotton cloth, and image density before and after rubbing was measured. Then the fixing ratio was determined employing the formula described below.

Fixing ratio (in percent)=[image density after rubbing]/(image density before rubbing)]×100

Further, a full-color image (having a pixel ratio of 15 percent for each yellow, magenta, cyan and black image) was continually printed onto 10,000 sheets under the high temperature and normal humidity (33° C. and 50% RH), after that the fixing characteristics are evaluated in the same way.

TABLE 13

| Example | Developer Bk | Developer Y | Developer M | Developer C | Fixing Efficiency Initial | Fixing Efficiency After 10,000 Copis | Stain | To Photo-receptor | Fine Line Reproduction* Initial | Fine Line Reproduction* After 50,000 Copis |
|---|---|---|---|---|---|---|---|---|---|---|
| 11 | 11Bk | 5Y | 5M | 5C | 98 | 97 | N. F.** | N. F. | 6 | 6 |
| 12 | 12Bk | 6Y | 6M | 6C | 98 | 97 | N. F. | N. F. | 6 | 6 |
| 13 | 13Bk | 7Y | 7M | 7C | 98 | 97 | N. F. | N. F. | 6 | 6 |

TABLE 13-continued

| Example | Developer Bk | Developer Y | Developer M | Developer C | Fixing Efficiency Initial | Fixing Efficiency After 10,000 Copis | Stain | To Photo-receptor | Fine Line Reproduction* Initial | Fine Line Reproduction* After 50,000 Copis |
|---|---|---|---|---|---|---|---|---|---|---|
| 14 | 14Bk | 8Y | 8M | 8C | 98 | 97 | N. F. | N. F. | 6 | 6 |
| 15 | 15Bk | 9Y | 9M | 9C | 98 | 97 | N. F. | N. F. | 6 | 6 |
| 16 | 16Bk | 10Y | 10M | 10C | 98 | 97 | N. F. | N. F. | 6 | 6 |
| 17 | 17Bk | 11Y | 11M | 11C | 98 | 97 | N. F. | N. F. | 6 | 6 |
| 18 | 18Bk | 5Y | 5M | 5C | 98 | 97 | N. F. | N. F. | 6 | 6 |
| 19 | 19Bk | 6Y | 6M | 6C | 98 | 97 | N. F. | N. F. | 6 | 6 |
| 20 | 20Bk | 7Y | 7M | 7C | 98 | 97 | N. F. | N. F. | 6 | 6 |
| 21 | 21Bk | 8Y | 8M | 8C | 98 | 97 | N. F. | N. F. | 6 | 6 |
| 22 | 22Bk | 9Y | 9M | 9C | 98 | 97 | N. F. | N. F. | 6 | 6 |
| 23 | 23Bk | 10Y | 10M | 10C | 98 | 97 | N.F. | N.F. | 6 | 6 |
| Comp. 3 | Comp. 3bk | Comp. 3y | Comp. 3m | Comp. 3c | 84 | 79 | 30,000 | 20,000 | 5 | 4.5 |
| Comp. 4 | Comp. 4bk | Comp. 4y | Comp. 4m | Comp. 4c | 74 | 63 | 15,000 | 10,000 | 6 | 4 |

Comp.: Comparative
*Lines/mm
**Not Found

The toner of the invention is excellent in the anti-offset ability and is able to give a high quality image without stain for a long period of time.

The toner of the invention releases no substance to be adhered onto the photoreceptor.

The toner of the invention is able to form an image without any stain and fault for a long period of time even when he toner is used in an image forming method including a process for forming a fixed image by a fixing device to which no or extreme small amount of silicone oil is supplied.

The toner of the invention is excellent in high fixing ability, the developing ability and the fine line reproducibility, and is able to form a high quality image for a long period of time.

What is claimed is:

1. A toner for developing an electrostatic image comprising a resin, a colorant and a releasing agent, wherein the toner particles are obtained by salting out/fusion-adhering a resin particle comprising a binding resin and a releasing agent together with a colorant particle, and the toner comprises the toner particles having a variation coefficient of a shape variation of not more than 16% and a number variation coefficient of the number particle size distribution of not more than 27%, and the releasing agent is a crystalline polyester represented by the Formula (1), $$R^1—(OCO—R^2)_n \quad (1):$$

wherein $R^1$ and $R^2$ each represent a hydrocarbon group having from 1 to 40 carbon atoms, which may have a substituent, and n is an integer of 1 to 4.

2. The toner of claim 1 wherein the toner particles not less than 65% in number has a shape coefficient of from 1.0 to 1.6.

3. The toner of claim 1 wherein the toner particles not less than 65% in number has a shape coefficient of from 1.2 to 1.6.

4. The toner of claim 1 wherein the toner particles not less than 50% in number are particles having no corner.

5. The toner of claim 1 wherein a number average particle size of the toner particles is from 3 to 8 μm.

6. The toner of claim 1 wherein a sum M of at least 70 percent, sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in μm) represents the particle size of a toner particle, while being divided into a plurality of classes at intervals of 0.23, and the number of particles is used as an ordinate.

7. The toner of claim 2 wherein the toner particles not less than 50% in number are particles having no corner and a number average particle size of the toner particles is from 3 to 8 μm.

8. The toner of claim 1 wherein $R^1$ represent a hydrocarbon group having from 1 to 20 carbon atoms, and $R^2$ represent a hydrocarbon group having from 16 to 30 carbon atoms and n is an integer of from 2 to 4.

9. The toner of claim 1 wherein content ratio of the releasing agents in the toner is from 1 to 30 percent by weight.

10. The toner of claim 1 wherein melting point of the crystalline polyester is from 50 to 130° C.

11. The toner of claim 1 wherein number average molecular weight of the crystalline polyester is from 1,500 to 15,000, and melt viscosity of the crystalline polyester (viscosity at melting point plus 20 degrees) is not more than 100 dPa·s.

12. The toner of claim 1 wherein a containing ratio of crystalline polyester in the toner is 1–50 weight parts.

13. The toner of claim 1 wherein melting point of the crystalline polyester is from 50 to 130° C., and number average molecular weight of the crystalline polyester is from 1,500 to 15,000, and melt viscosity of the crystalline polyester (viscosity at melting point plus 20 degrees) is not more than 100 dPa·s.

14. A toner for developing an electrostatic image comprising a resin, a colorant and a releasing agent, wherein the toner particles are obtained by salting out/fusion-adhering a resin particle comprising a binding resin and a releasing agent together with a colorant particle, and the toner comprises the toner particles having no corner of not less than 50% in number, and a number variation coefficient of the number particle size distribution of not more than 27%, and the releasing agent is a crystalline polyester represented by the Formula (1), $$R^1—(OCO—R^2)_n \quad (1):$$

wherein $R^1$ and $R^2$ each represent a hydrocarbon group having from 1 to 40 carbon atoms, which may have a substituent, and n is an integer of 1 to 4.

15. The toner of claim 14 wherein the toner particles not less than 65 in number has a shape coefficient of from 1.0 to 1.6.

16. The toner of claim 14 wherein the toner particles not less than 65% in number has a shape coefficient of from 1.2 to 1.6.

17. The toner of claim 14 wherein the toner particles not less than 50% in number are particles having no corner and a number average particle size of the toner particles is from 3 to 8 μm.

18. The toner of claim 14 wherein a sum M of at least 70 percent, sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in μm) represents the particle size of a toner particle, while being divided into a plurality of classes at intervals of 0.23, and the number of particles is used as an ordinate.

19. The toner of claim 14 wherein melting point of the crystalline polyester is from 50 to 130° C., and number average molecular weight of the crystalline polyester is from 1,500 to 15,000, and melt viscosity of the crystalline polyester (viscosity at melting point plus 20 degrees) is not more than 100 dPa·s.

20. A toner for developing an electrostatic image comprising a resin, a colorant and a releasing agent, wherein the toner particles are obtained by salting out/fusion-adhering a resin particle comprising a binding resin and a releasing agent together with a colorant particle, and the toner particles not less than 65% in number has a shape coefficient of from 1.2 to 1.6, and a variation coefficient of a shape variation of the toner particles is not more than 16%, and the releasing agent is a crystalline polyester represented by the Formula (1), $$R^1—(OCO—R^2)_n \quad (1):$$

wherein $R^1$ and $R^2$ each represent a hydrocarbon group having from 1 to 40 carbon atoms, which may have a substituent, and n is an integer of 1 to 4.

21. The toner of claim 20 wherein the toner particles not less than 50% in number are particles having no corner.

22. The toner of claim 20 wherein a sum M of at least 70 percent, sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in μm) represents the particle size of a toner particle, while being divided into a plurality of classes at intervals of 0.23, and the number of particles is used as an ordinate.

23. The toner of claim 20 wherein the releasing agent is represented by the Formula (1), $$R^1—(OCO—R^2)_n \quad (1):$$

wherein $R^1$ and $R^2$ each represent a hydrocarbon group having from 1 to 40 carbon atoms, which may have a substituent, and n is an integer of 1 to 4, melting point of the crystalline polyester is from 50 to 130° C., and number average molecular weight of crystalline polyester is from 1,500 to 15,000, and melt viscosity of a crystalline polyester (viscosity at melting point plus 20 degrees) is not more than 100 dPa·s.

* * * * *